US011632626B2

(12) United States Patent
Taghizadeh et al.

(10) Patent No.: US 11,632,626 B2
(45) Date of Patent: Apr. 18, 2023

(54) AUDIO ENCODING DEVICE AND METHOD

(71) Applicant: Huawei Technologies Co., Ltd., Shenzhen (CN)

(72) Inventors: Mohammad Taghizadeh, Munich (DE); Christof Faller, Uster (CH); Alexis Favrot, Uster (CH)

(73) Assignee: Huawei Technologies Co., Ltd., Shenzhen (CN)

( * ) Notice: Subject to any disclaimer, the term of this patent is extended or adjusted under 35 U.S.C. 154(b) by 164 days.

(21) Appl. No.: 17/019,757

(22) Filed: Sep. 14, 2020

(65) Prior Publication Data

US 2021/0067868 A1 Mar. 4, 2021

Related U.S. Application Data

(63) Continuation of application No. PCT/EP2018/056411, filed on Mar. 14, 2018.

(51) Int. Cl.

| | |
|---|---|
| ***H04S 3/02*** | (2006.01) |
| ***H04R 3/00*** | (2006.01) |
| ***H04R 1/40*** | (2006.01) |
| ***G10L 19/008*** | (2013.01) |
| ***G10L 19/02*** | (2013.01) |
| ***H04R 3/02*** | (2006.01) |

(52) U.S. Cl.

CPC ..... *H04R 1/406* (2013.01); *G10L 19/008* (2013.01); *G10L 19/02* (2013.01); *H04R 3/02* (2013.01); *H04R 2430/21* (2013.01); *H04S 2400/15* (2013.01)

(58) Field of Classification Search

CPC ..... H04S 3/02; H04R 3/00
USPC ..... 381/22–23, 92
See application file for complete search history.

(56) References Cited

U.S. PATENT DOCUMENTS

| | | | | |
|---|---|---|---|---|
| 2015/0215721 | A1 | 7/2015 | Sato et al. | |
| 2019/0200155 | A1* | 6/2019 | Zhang | H04R 29/005 |

FOREIGN PATENT DOCUMENTS

| | | | |
|---|---|---|---|
| CN | 104904240 | A | 9/2015 |
| CN | 105378826 | A | 3/2016 |
| CN | 205249484 | U | 5/2016 |
| EP | 1737271 | A1 | 12/2006 |
| EP | 2738762 | A1 | 6/2014 |

OTHER PUBLICATIONS

Miai Hai-ming et al., "Virtual source localization experiment on mixed-order ambisonics reproduction," Technical Acoustics, vol. 36, No. 5 Pt.2, total 3 pages (Oct. 2017). With an English Abstract.

(Continued)

*Primary Examiner* — George C Monikang
(74) *Attorney, Agent, or Firm* — Leydig, Voit & Mayer, Ltd.

(57) ABSTRACT

A method and a device encode N audio signals, from N microphones where N≥3. For each pair of the N audio signals an angle of incidence of direct sound is estimated. A-format direct sound signals are derived from the estimated angles of incidence by deriving from each estimated angle an A-format direct sound signal. Each A-format direct sound signal is a first-order virtual microphone signal, for example, a cardioids signal.

16 Claims, 10 Drawing Sheets

(56) References Cited

OTHER PUBLICATIONS

Benjamin et al.,"A Soundfield Microphone Using Tangential Capsules," Audio Engineering Society, Convention Paper 8240, Presented at the 129th Convention, San Francisco, CA, USA, XP040567210, total 12 pages (Nov. 4-7, 2010).
Meyer et al.,"A Highly Scalable Spherical Microphone Array Based on an Orthonormal Decomposition of the Soundfield," 2002 IEEE International Conference on Acoustics, Speech, and Signal Processing, total 4 pages, Institute of Electrical and Electronics Engineers, New York, New York (Date Added to IEEE Xplore: Apr. 7, 2011).
Farina et al., "Spatial PCM Sampling: A New Method for Sound Recording and Playback," AES 52nd International Conference, Guildford, UK, XP040633139, total 13 pages (Sep. 2-4, 2013).
Zotter, "Analysis and Synthesis of Sound-Radiation with Spherical Arrays," Institute of Electronic Music and Acoustics University of Music and Performing Arts, Austria, total 192 pages (Sep. 2009).
Merimaa, "Applications of a 3-D Microphone Array," Audio Engineering Society, Convention Paper 5501, Presented at the 112th Convention, total 11 pages, Munich, Germany (May 10-13, 2002).
Brown et al.,"Complex Variables and Applications," Eighth Edition, the McGraw-Hill Higher Education, total 482 pages (2009).
Delikaris-Manias et al.,"Cross Pattern Coherence Algorithm for Spatial Filtering Applications Utilizing Microphone Arrays," IEEE Transactions on Audio, Speech, and Language Processing, vol. 21, No. 11, pp. 2356-2367, Institute of Electrical and Electronics Engineers, New York, New York (Nov. 2013).
Pulkki, "Directional audio coding in spatial sound reproduction and stereo upmixing," total 8 pages, AES 28th International Conference, Pitea, Sweden (Jun. 30-Jul. 2, 2006).
Taghizadeh et al,."Enhanced diffuse field model for ad hoc microphone array calibration," Signal Processing 101 (2014), pp. 242-255, Elsevier B.V. All rights reserved, total 14 pages (2014).
Olson, "Gradient Microphones," The Journal of the Acoustical Society of America, vol. 17, No. 3, total 7 pages (Jan. 1946).
Tournery et al., "Improved Time Delay Analysis/Synthesis for Parametric Stereo Audio Coding," total 9 pages, Audio Engineering Society, Convention Paper, Presented at the 120th Convention, Paris, France (May 20-23, 2006).
Cook et al., "Measurement of Correlation Coefficients in Reverberant Sound Fields," The Journal of the Acoustical Society of America, vol. 27, No. 6, total 6 pages (Nov. 1955).
Pulkki, "Microphone techniques and directional quality of sound reproduction," total 18 pages, Audio Engineering Society, Convention Paper 5500, Presented at the 112th Convention, Munich, Germany (May 10-13, 2002).
Tylka et al., "On the Calculation of Full and Partial Directivity Indices," total 12 pages, 3D Audio and Applied Acoustics Laboratory, Princeton University, 3D3A Lab Technical Report #1—Nov. 16, 2014 Revised Feb. 19, 2016.
Gerzon, "Practical Periphony: The Reproduction of Full-Sphere sound," In Preprint 65th Conv. Aud. Eng. Soc., total 6 pages (Feb. 1980).
J. Daniel, "Représentation de champs acoustiques, application à la transmission et à la reproduction de scènes sonores complexes dans un contexte multimédia," PhD thesis, Thèse de doctoral de l'Université Paris 6, total 319 pages (2001). With an English Abstract.
C. Schorkhuber et al., "Signal-Dependent Encoding for First-Order Ambisonic Microphones," DAGA 2017 Kiel, total 4 pages (2017).
Farrar, "Soundfield microphone: Design and development of microphone and control unit," total 8 pages, Wireless World (Oct. 1979).
Epain et al., "Spherical Harmonic Signal Covariance and Sound Field Diffuseness," IEEE/ACM Transactions on Audio, Speech, and Language Processing, vol. 24, No. 10, total 12 pages (Oct. 2016).
Berg, "The Future of Audio Technology—Surround and Beyond, the Proceedings of the AES 28th International Conference," total 9 pages, Pitea, Sweden (Jun. 30-Jul. 2, 2006).
C. T. Molloy, "Calculation of the Directivity Index for Various Types of Radiators," The Journal of the Acoustical Society of America, vol. 20, No. 4, total 20 pages (Jul. 1948).
M. R. Schroeder, "Natural Sounding Artificial Reverberation," Presented at the 13th Annual Meeting, total 18 pages (Oct. 9-13, 1961).
Gerzon, "Periphony: With-Height Sound Reproduction," Presented Mar. 1972, at the 2nd Convention of the Central Europe Section of the Andio Engineering Society, Munich, Germany, Journal of the Audio Engineering Society, total 9 pages.
Pulkki et al., "Directional audio coding—perception—based reproduction of spatial sound," International Workshop on the Principles and Applications of Spatial Hearing, Zao, Miyagi, Japan, total 5 pages (Nov. 11-13, 2009).
M. Bodden, "Modeling human sound-source localization and the cocktail-party-effect," acta acustica 1(1993) 43-45, total 7 pages (Feb./Apr. 1993).
Gerzon, "Ambisonics in Multichannel Broadcasting and Video,", total 13 pages, Presented at the 74th Convention of the Audio Engineering Society, New York, Oct. 8-12, 1983, J. Audio Eng. Soc., vol. 33, No. 11, Nov. 1985.
Benjamin et al., "The Native B-format Microphone: Part I," total 15 pages, Audio Engineering Society, Convention Paper 6621, Presented at the 119th Convention, New York, New York, USA (Oct. 7-10, 2005).
Tournery et al.,"Converting Stereo Microphone Signals Directly to MPEG-Surround," Audio Engineering Society, Convention Paper 7982, Presented at the 128th Convention, total 11 pages, London, UK (May 22-25, 2010).
Faller, "Conversion of Two Closely Spaced Omnidirectional Microphone Signals to an XY Stereo Signal," Audio Engineering Society, Convention Paper 8188, Presented at the 129th Convention, total 10 pages, San Francisco, CA, USA (Nov. 4-7, 2010).
Walther et al.,"Linear Simulation of Spaced Microphone Arrays Using B-Format Recordings," total 7 pages, Audio Engineering Society, Convention Paper 7987, Presented at the 128th Convention, London, UK (May 22-25, 2010).

* cited by examiner

AUDIO ENCODING DEVICE AND METHOD

CROSS-REFERENCE TO RELATED APPLICATIONS

This application is a continuation of International Patent Application Number PCT/EP2018/056411, filed on Mar. 14, 2018, the disclosure of which is hereby referenced in its entirety.

FIELD

The present disclosure is related to audio recording and encoding, in particular for virtual reality applications, especially for virtual reality provided by a small portable device.

BACKGROUND

Virtual reality (VR) sound recording typically requires Ambisonic B-format with expensive directive microphones. Professional audio microphones exist to either record A-format to be encoded into Ambisonic B-format or directly Ambisonic B-format, for instance using Soundfield microphones. More generally speaking, it is technically difficult to arrange omnidirectional microphones on a mobile device to capture sound for VR.

A way to generate Ambisonic B-format signals, given a distribution of omnidirectional microphones, is based on differential microphone arrays, i.e. applying delay and adding beam-forming in order to derive first order virtual microphone (e.g. cardioids) signals as A-format.

The first limitation of this technique results from its spatial aliasing which, by design, reduces the bandwidth to frequencies f in the range:

$$f < \frac{c}{4d_{mic}}, \tag{1}$$

where c stands for the sound celerity and $d_{mic}$ the distance between a pair of two omnidirectional microphones. A second weakness results, for higher order Ambisonic B-format, from the microphone requirement. The required number of microphones and their required positions are not anymore suitable for mobile devices.

Another way of generating ambisonic B-format signals from omnidirectional microphones corresponds to sampling the sound field at the recording point in space using a sufficiently dense distribution of microphones. These sampled sound pressure signals are then converted to spherical harmonics, and can be linearly combined to eventually generate B-format signals.

The main limitation of such approaches is the required number of microphones. For consumer applications, with only few microphones (commonly up to 6), linear processing is too limited, leading to signal to noise ratio (SNR) issues at low frequencies, and aliasing at high frequencies.

Directional Audio Coding (DirAc) is a further method for spatial sound representation, but it does not generate B-format signals. Instead, it reads first order B-format signals and generates a number of related audio parameters (direction of arrival, diffuseness) and adds these to an omnidirectional audio channel. Later, the decoder takes the above information and converts it to a multi-channel audio signal using amplitude panning for direct sound and de-correlating for diffuse sound.

DirAc is thus a different technique, which takes B-format as input to render it to its own audio format.

SUMMARY

Therefore, the present inventors have recognized a need to provide an audio encoding device and method, which allow for generating ambisonic B-format sound signals, while requiring only a low number of microphones, and achieving a high output sound quality.

Embodiments of the present disclosure provide such audio encoding devices and methods that allow for generating ambisonic B-format sound signals, while requiring only a low number of microphones, and achieve a high output sound quality.

According to a first aspect of the present disclosure, an audio encoding device, for encoding N audio signals, from N microphones, where N≥3, is provided. The device comprises a delay estimator, configured to estimate angles of incidence of direct sound by estimating for each pair of the N audio signals an angle of incidence of direct sound, and a beam deriver, configured to derive A-format direct sound signals from the estimated angles of incidence by deriving from each estimated angle of incidence an A-format direct sound signal, each A-format direct sound signal being a first-order virtual microphone signal, especially a cardioids signal. This allows for determining the A-format direct sound signals with a low hardware effort.

According to an implementation form of the first aspect, the device additionally comprises an encoder, configured to encode the A-format direct sound signals in first-order ambisonic B-format direct sound signals by applying a transformation matrix to the A-format direct sound signals. This allows for generating ambisonic B-format signals using only a very low number of microphones, but still achieving a high output sound quality.

According to an implementation form of the first aspect, N=3. The audio encoding device moreover comprises a short time Fourier transformer, configured to perform a short time Fourier transformation on each of the N audio signals $x_1$, $x_2$, $x_3$, resulting in N short time Fourier transformed audio signals $X_1[k,i]$, $X_2[k,i]$, $X_3[k,i]$. The delay estimator is then configured to determine cross spectra of each pair of short time Fourier transformed audio signals according to:

$$X_{12}[k,i]=\alpha_X X_1[k,i]X^*_2[k,i]+(1-\alpha_X)X_{12}[k-1,i],$$

$$X_{13}[k,i]=\alpha_X X_1[k,i]X^*_3[k,i]+(1-\alpha_X)X_{13}[k-1,i],$$

$$X_{23}[k,i]=\alpha_X X_2[k,i]X^*_3[k,i]+(1-\alpha_X)X_{23}[k-1,i],$$

determine an angle of the complex cross spectrum of each pair of short time Fourier transformed audio signals according to:

$$\tilde{\psi}_{12}[k,i] = \arctan j\frac{X_{12}[k,i]X^*_{12}[k,i]}{X_{12}[k,i]+X^*_{12}[k,i]},$$

$$\tilde{\psi}_{13}[k,i] = \arctan j\frac{X_{13}[k,i]X^*_{13}[k,i]}{X_{13}[k,i]+X^*_{13}[k,i]},$$

$$\tilde{\psi}_{23}[k,i] = \arctan j\frac{X_{23}[k,i]X^*_{23}[k,i]}{X_{23}[k,i]+X^*_{23}[k,i]},$$

perform a phase unwrapping to $\tilde{\psi}_{12}$, $\tilde{\psi}_{13}$, $\tilde{\psi}_{23}$, resulting in $\Psi_{12}$, $\Psi_{13}$, $\Psi_{23}$ estimate the delay in number of samples according to:

$$\delta_{12}[k,i]=(N_{STFT}/2+1)/(i\pi)\psi_{12}[k,i],$$

$$\delta_{13}[k,i]=(N_{STFT}/2+1)/(i\pi)\psi_{13}[k,i],$$

$$\delta_{23}[k,i]=(N_{STFT}/2+1)/(i\pi)\psi_{23}[k,i], \text{ if } i\leq i_{alias}$$

or $$\delta_{12}[k,i]=(N_{STFT}/2+1)/(i\pi)\Psi_{12}[k,i],$$

$$\delta_{13}[k,i]=(N_{STFT}/2+1)/(i\pi)\Psi_{13}[k,i],$$

$$\delta_{23}[k,i]=(N_{STFT}/2+1)/(i\pi)\Psi_{23}[k,i], \text{ if } i>i_{alias}$$

estimate the delay in seconds according to:

$$\tau_{12}[k,i]=\frac{\delta_{12}[k,i]}{f_s}$$

$$\tau_{13}[k,i]=\frac{\delta_{13}[k,i]}{f_s}$$

$$\tau_{23}[k,i]=\frac{\delta_{23}[k,i]}{f_s}$$

estimate the angles of incidence according to:

$$\theta_{12}[k,i]=\arcsin\left(\frac{c\ \tau_{12}[k,i]}{d_{mic}}\right),$$

$$\theta_{13}[k,i]=\arcsin\left(\frac{c\ \tau_{13}[k,i]}{d_{mic}}\right),$$

$$\theta_{23}[k,i]=\arcsin\left(\frac{c\ \tau_{23}[k,i]}{d_{mic}}\right),$$

wherein $x_1$ is a first audio signal of the N audio signals, $x_2$ is a second audio signal of the N audio signals, $x_3$ is a third audio signal of the N audio signals, $X_1$ is a first short time Fourier transformed audio signal, $X_2$ is a second short time Fourier transformed audio signal, $X_3$ is a third short time Fourier transformed audio signal, k is a frame of the short time Fourier transformed audio signal, and i is a frequency bin of the short time Fourier transformed audio signal, $X_{12}$ is a cross spectrum of a pair of $X_1$ and $X_2$, $X_{13}$ is a cross spectrum of a pair of $X_1$ and $X_3$, $X_{23}$ is a cross spectrum of a pair of $X_2$ and $X_3$, $\alpha_x$ is a forgetting factor, X* is the conjugate complex of X, j is the imaginary unit, $\tilde{\psi}_{12}$ is an angle of the complex cross spectrum of $X_{12}$, $\psi_{13}$ is an angle of the complex cross spectrum of $X_{13}$, $\psi_{23}$ is an angle of the complex cross spectrum of $X_{23}$, $i_{alias}$ is a frequency bin corresponding to an aliasing frequency, $f_s$ is a sampling frequency, $d_{mic}$ is a distance of the microphones, and c is the speed of sound. This allows for a simple and efficient determining of the delays.

According to a further implementation form of the first aspect, the beam deriver is configured to determine cardioid directional responses according to:

$$D_{12}[k,i]=\frac{1}{2}\left(1+\cos\left(\theta_{12}[k,i]-\frac{\pi}{2}\right)\right),$$

$$D_{13}[k,i]=\frac{1}{2}\left(1+\cos\left(\theta_{13}[k,i]-\frac{\pi}{2}\right)\right),$$

$$D_{23}[k,i]=\frac{1}{2}\left(1+\cos\left(\theta_{23}[k,i]-\frac{\pi}{2}\right)\right),$$

and derive the A-format direct sound signals according to:

$$A_{12}[k,i]=D_{12}[k,i]X_1[k,i],$$

$$A_{13}[k,i]=D_{13}[k,i]X_1[k,i],$$

$$A_{23}[k,i]=D_{23}[k,i]X_1[k,i],$$

wherein

D is a cardioid directional response, and

A is an A-format direct sound signal. This allows for a simple and efficient determining of the beam signals.

According to a further implementation form of the first aspect, the encoder is configured to encode the A-format direct sound signals to the first-order ambisonic B-format direct sound signals according to:

$$\begin{bmatrix} R_W \\ R_X \\ R_Y \end{bmatrix}=\Gamma^{-1}\begin{bmatrix} A_{12} \\ A_{13} \\ A_{23} \end{bmatrix},$$

wherein $R_W$ is a first, zero-order ambisonic B-format direct sound signal, $R_x$ is a first, first-order ambisonic B-format direct sound signal, $R_y$ is a second, first-order ambisonic B-format direct sound signal, and $\Gamma^{-1}$ is the transformation matrix. This allows for a simple and efficient determining of the beam signals.

According to a further implementation form of the first aspect, the device comprises a direction of arrival estimator, configured to estimate a direction of arrival from the first-order ambisonic B-format direct sound signals, and a higher order ambisonic encoder, configured to encode higher order ambisonic B-format direct sound signals, using the first-order ambisonic B-format direct sound signals and the estimated direction of arrival, wherein higher order ambisonic B-format direct sound signals have an order higher than one. Thereby, an efficient encoding of the ambisonic B-format direct sound signal is achieved.

According to a further implementation form of the first aspect, the direction of arrival estimator is configured to estimate the direction of arrival according to:

$$\theta_{XY}[k,i]=\arctan\frac{R_Y[k,i]}{R_X[k,i]},$$

wherein $\theta_{XY}$ [k,i] is a direction of arrival of a direct sound of frame k and frequency bin i. This allows for a simple and efficient determining of the directions of arrival.

According to a further implementation form of the first aspect, the higher order ambisonic B-format direct sound signals comprise second order ambisonic B-format direct sound signals limited to two dimensions, wherein the higher order ambisonic encoder is configured to encode the second order ambisonic B-format direct sound signals according to:

$$R_R \triangleq (3\sin^2\phi - 1)/2 = -1/2,$$

$$R_S \triangleq \sqrt{3}/2 \cos\theta \sin 2\phi = 0,$$

$$R_T \triangleq \sqrt{3}/2 \sin\theta \sin 2\phi = 0,$$

$$R_U \triangleq \sqrt{3}/2 \cos 2\theta \cos^2\phi = \sqrt{3}/2 \cos 2\theta_{XY},$$

$$R_V \triangleq \sqrt{3}/2 \sin 2\theta \cos^2\phi = \sqrt{3}/2 \sin 2\theta_{XY},$$

wherein $R_R$ is a first, second-order ambisonic B-format direct sound signal, $R_S$ is a second, second-order ambisonic B-format direct sound signal, $R_T$ is a third, second-order ambisonic B-format direct sound signal, $R_U$ is a fourth, second-order ambisonic B-format direct sound signal, $R_V$ is a fifth, second-order ambisonic B-format direct sound signal, $\triangleq$ denotes "defined as", $\phi$ is an elevation angle, and $\theta$ is an azimuth angle. This allows for an efficient encoding of the higher order ambisonic B-format signals.

According to a further implementation form of the first aspect, the audio encoding device comprises a microphone matcher, configured to perform a matching of the N frequency domain audio signals, resulting in N matched frequency domain audio signals. This allows for further quality increase of the output signals.

According to a further implementation form of the first aspect, the audio encoding device comprises a diffuse sound estimator, configured to estimate a diffuse sound power, and a de-correlation filter bank, configured to perform a de-correlation of the diffuse sound power by generating three orthogonal diffuse sound components from the diffuse sound estimate power. This allows for implementing diffuse sound into the output signals.

According to a further implementation form of the first aspect, the diffuse sound estimator is configured to estimate the diffuse sound power according to:

$$A = 1 - \Phi_{diff}^2,$$

$$V = 2\Phi_{diff} E\{X_1 X_2^*\} - E\{X_1 X_1^*\} - E\{X_2 X_2^*\},$$

$$C = E\{X_1 X_1^*\} E\{X_2 X_2^*\} - E\{X_1 X_2^*\}^2,$$

$$P_{diff}[k, i] = \frac{-B - \sqrt{B^2 - 4AC}}{2A},$$

wherein $P_{diff}$ is the diffuse sound power, $E\{\ \}$ is an expectation value, $\Phi_{diff}^2$ is a normalized cross-correlation coefficient between $N_1$ and $N_2$, $N_1$ is diffuse sound in a first channel, and $N_2$ is diffuse sound in a second channel. This allows for an especially efficient estimation of the diffuse sound power.

According to a further implementation form of the first aspect, the de-correlation filter bank is configured to perform the de-correlation of the diffuse sound power by generating three orthogonal diffuse sound components from the diffuse sound estimate power:

$$\tilde{D}_W[k,i] = \mathrm{DFR}_W w_u U_1 P_{2D\text{-}diff}[k,i],$$

$$\tilde{D}_X[k,i] = \mathrm{DFR}_X w_u U_2 P_{2D\text{-}diff}[k,i],$$

$$\tilde{D}_Y[k,i] = \mathrm{DFR}_Y w_u U_3 P_{2D\text{-}diff}[k,i],$$

wherein $$DFR_a \triangleq \frac{1}{4\pi} \int_{-\frac{\pi}{2}}^{\frac{\pi}{2}} \int_{-\pi}^{\pi} |R_a(\theta, \phi)|^2 \cos\phi \, d\theta \, d\phi,$$

$$R_X(\theta, \phi) = \cos\phi \cos\theta$$

$$R_Y(\theta, \phi) = \cos\phi \sin\theta$$

$$R_W(\theta, \phi) = 1$$

$$w_u[n] = \exp\left(-\frac{0.5 \ln 1e6 \, |n|}{f_s RT_{60}}\right) \text{ with } -l_u < n < l_u$$

wherein $\tilde{D}_W[k,i]$ is a first channel diffuse sound component, wherein $\tilde{D}_X[k,i]$ is second channel diffuse sound component, wherein $\tilde{D}_Y[k,i]$ is third channel diffuse sound component, $\mathrm{DFR}_W$ is a diffuse-field response of the first channel, $\mathrm{DFR}_X$ is a diffuse-field response of the second channel, $\mathrm{DFR}_Y$ is a diffuse-field response of the third channel, $w_u$ is an exponential window, $RT_{60}$ is a reverberation time, $U_1, U_2, U_3$ is the de-correlation filter bank, u is Gaussian noise sequence, $l_u$ is a given length of the Gaussian noise sequence, and $P_{2D\text{-}diff}$ is the diffuse noise power. Thereby, an efficient de-correlation of the diffuse sound power is calculated.

According to a further implementation form of the first aspect, the audio encoding device comprises an adder, configured to add channel-wise, the first-order ambisonic B-format direct sound signals and the higher order ambisonic B-format direct sound signals, and/or the diffuse sound signals, resulting in complete ambisonic B-format signals. Thereby, in a simple manner, a finished output signal is generated.

According to a second aspect of the present disclosure, an audio recording device comprising N microphones configured to record the N audio signals and an audio encoding device according to the first aspect or any of the implementation forms of the first aspect is provided. This allows for an audio recording and encoding in a single device.

According to a third aspect of the present disclosure, a method for encoding N audio signals, from N microphones, where N≥3 is provided. The method comprises estimating angles of incidence of direct sound by estimating for each pair of the N audio signals an angle of incidence of direct sound, and deriving A-format direct sound signals from the estimated angles of incidence by deriving from each estimated angle of incidence an A-format direct sound signal, each A-format direct sound signal being a first-order virtual microphone signal. This allows for determining the A-format direct sound signals with a low hardware effort.

According to an implementation form of the third aspect, the method additionally comprises encoding the ambisonic A-format direct sound signals in first-order ambisonic B-format direct sound signals by applying at least one transformation matrix to the A-format direct sound signals. This allows for a simple and efficient determining of the ambisonic B-format direct sound signals.

The method may further comprise extracting higher order ambisonic B-format direct sound signals by extracting direction of arrival from first order ambisonic B-format direct sound signals.

According to a fourth aspect of the present disclosure, a computer program with a program code for performing the method according to the third aspect is provided.

A method is provided for parametric encoding of multiple omnidirectional microphone signals into any order Ambisonic B-format by means of:

robust estimation of the angle of incidence of sound, based on microphone pair beam signals and de-correlation of diffuse sound The disclosed approach is based on at least three omnidirectional microphones on a mobile device. Successively, it estimates the angles of incidence of direct sound by means of delay estimation between the different microphone pairs. Given the incidences of direct sound, it derives beam signals, called the direct sound A-format signals. The direct sound A-format signals are then encoded into first order B-format using relevant transformation matrix.

For optional higher order B-format, a direction of arrival estimate is derived from the X and Y first order B-format signals. The diffuse, non-directive sound is optionally rendered as multiple orthogonal components, generated using de-correlation filters.

Generally, it has to be noted that all arrangements, devices, elements, units and means and so forth described in the present application could be implemented by software or hardware elements or any kind of combination thereof. Furthermore, the devices may be processors or may comprise processors, wherein the functions of the elements, units and means described in the present applications may be implemented in one or more processors. All steps which are performed by the various entities described in the present application as well as the functionality described to be performed by the various entities are intended to mean that the respective entity is adapted to or configured to perform the respective steps and functionalities. Even if in the following description or exemplary embodiments, a specific functionality or step to be performed by a general entity is not reflected in the description of a specific detailed element of that entity which performs that specific step or functionality, it should be clear for a skilled person that these methods and functionalities can be implemented in respect of software or hardware elements, or any kind of combination thereof.

BRIEF DESCRIPTION OF DRAWINGS

The present disclosure is in the following explained in detail in relation to embodiments of the present disclosure in reference to the enclosed drawings, in which.

DETAILED DESCRIPTION

Figure 1:
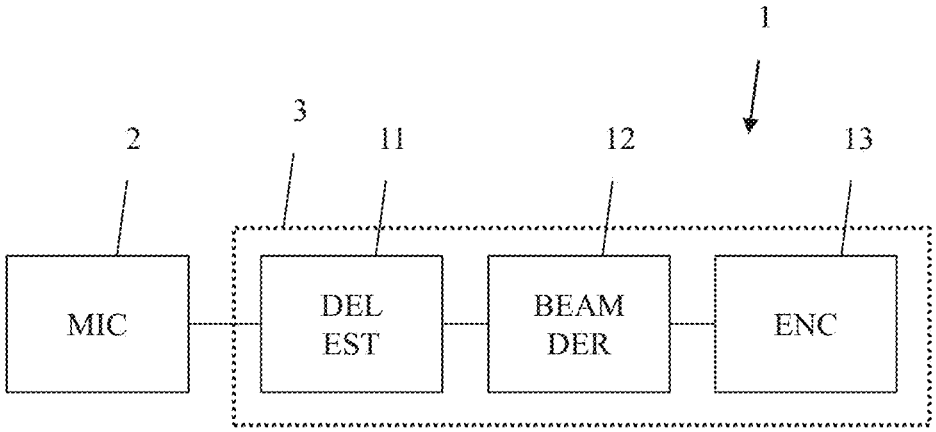
FIG. 1 shows a first embodiment of the audio encoding device according to the first aspect of the present disclosure and the audio recording device according to the second aspect of the present disclosure.

First, we demonstrate the construction and general function of an embodiment of the first aspect and second aspect of the present disclosure along FIG. 1. With regard to FIG. 2-FIG. 9, further details of the construction and function of the first embodiment and the second embodiment are shown. With regard to FIG. 10, finally the function of an embodiment of the third aspect of the present disclosure is described in detail.

In FIG. 1, a first embodiment of the audio encoding device 3 is shown. Moreover, a first embodiment of the audio recording device 1 according to the second aspect of the present disclosure is shown.

The audio recording device 1 comprises a number of $N \geq 3$ microphones 2, which are connected to the audio encoding device 3. The audio encoding device 3 comprises a delay estimator 11, which is connected to the microphones 2. The audio encoding device 3 moreover comprises a beam deriver 12, which is connected to the delay estimator. Furthermore, the audio encoding device 3 comprises an encoder 13, which is connected to the beam deriver 12. Note that the encoder 13 is an optional feature with regard to the first aspect of the present disclosure.

In order to determine ambisonic B-format direct sound signals, the microphones 2 record $N \geq 3$ audio signals. These audio signals are preprocessed by components integrated into the microphones 2, in this diagram. For example, a transformation into the frequency domain is performed. This will be shown in more detail along FIG. 2. The preprocessed audio signals are handed to the delay estimator 11, which estimates angles of incidence of direct sound by estimating for each pair of the N audio signals and angle of incidence of direct sound. These angles of incidence of direct sound are handed to the beam deriver 12, which derives A-format direct sound signals therefrom. Each A-format direct sound signal is a first-order virtual microphone signal, especially a cardioid signal. These signals are handed on to the encoder 13, which encodes the A-format direct sound signals to first-order ambisonic B-format direct sound signals by applying a transformation matrix to the A-format direct sound signals. The encoder outputs the first-order ambisonic B-format direct sound signals.

Figure 2:
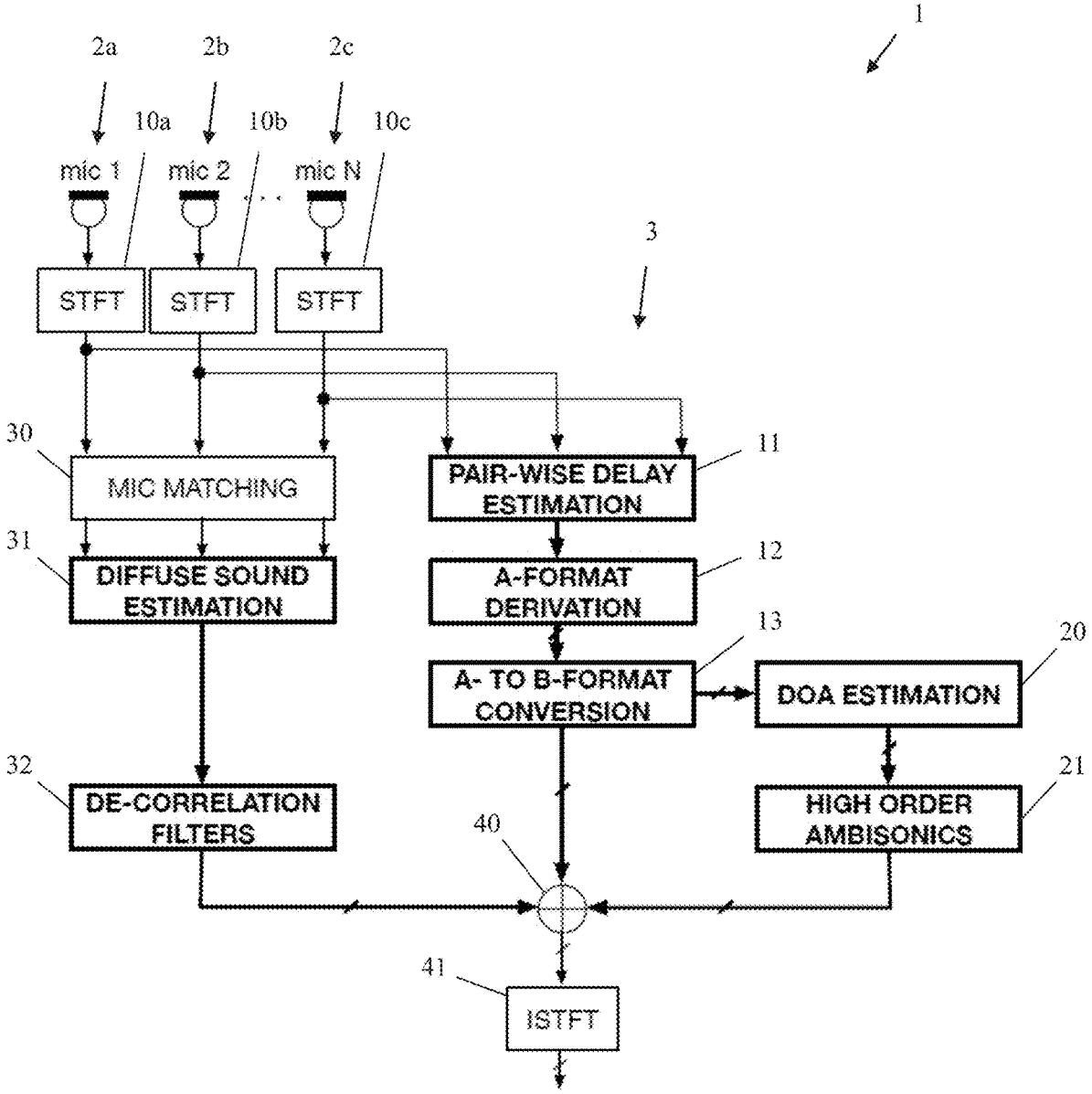
FIG. 2 shows a second embodiment of the audio encoding device according to the first aspect of the present disclosure and the audio recording device according to the second aspect of the present disclosure.

In FIG. 2, a second embodiment of the audio encoding device 3 and the audio recording device 1 are shown. Here, the individual microphones 2*a*, 2*b*, 2*c*, which correspond to the microphones 2 of FIG. 1, are shown. Each of the microphones 2*a*, 2*b*, 2*c* is connected to a short-time Fourier transformer 10*a*, 10*b*, 10*c*, which each performs a short-time Fourier transformation of the N audio signals resulting in N short-time Fourier transformed audio signals. These are handed on to the delay estimator 11, which performs the delay estimation and hands the angles of incidence to the beam deriver 12. The beam deriver 12 determines the A-format direct sound signals and hands them to the encoder 13, which performs the encoding to B-format direct sound signals. In FIG. 2, further components of the audio encoding device 3 are shown. Here, the audio encoding device 3 moreover comprises a direction-of-arrival estimator 20, which is connected to the encoder 13. Moreover, it comprises a higher order ambisonic encoder 21, which is connected to the direction-of-arrival estimator 20.

The direction-of-arrival estimator 20 estimates a direction of arrival from the first-order ambisonic B-format direct sound signals and hands it to the higher order ambisonic encoder 21. The higher order ambisonic encoder 21 encodes higher order ambisonic B-format direct sound signals, using the first-order ambisonic B-format direct sound signals and the estimated direction of arrival as an input. The higher order ambisonic B-format direct sound signals have a higher order than 1.

Moreover, the audio encoding device 3 comprises a microphone matcher 30, which performs a matching of the N frequency domain audio signals output by the short-time Fourier transformers 10*a*, 10*b*, 10*c* resulting in N match frequency domain audio signals. Connected to the microphone matcher 30, the audio encoding device 3 moreover comprises a diffuse sound estimator 31, which is configured to estimate a diffuse sound power based upon the N match frequency domain audio signals. Furthermore, the audio encoding device 3 comprises a de-correlation filter bank 32, which is connected to the diffuse sound estimator 31 and configured to perform a de-correlation of the diffuse sound power by generating three orthogonal diffuse sound components from the diffuse sound estimate power.

Finally, the audio encoding device 3 comprises an adder 40, which adds the first-order B-format direct sound signals provided by the encoder 13, the higher order ambisonic B-format signals provided by the higher order encoder 21 and the diffuse sound components provided by the de-correlation filter bank 32. The sum signal is handed to an inverse short-time Fourier transformer 41, which performs an inverse short-time Fourier transformation to achieve the final ambisonic B-format signals in the time domain.

In the following, along FIG. 3-9, further details regarding the function of the individual components, shown in FIG. 2 are described.

Figure 3:
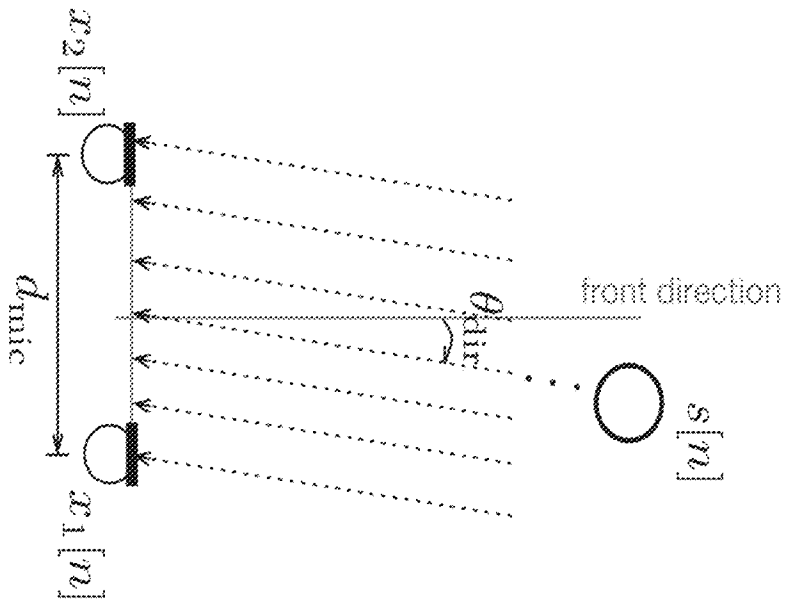
FIG. 3 shows a pair of microphones in a diagram depicting the determining of an angle of incidence of a sound event.

In FIG. 3, an angle of incidence, as it is determined by the delay estimator 11 is shown.

Especially, the propagation of direct sound following a ray from a sound source to a pair of microphones in the free-field is considered in FIG. 3.

Figure 4:
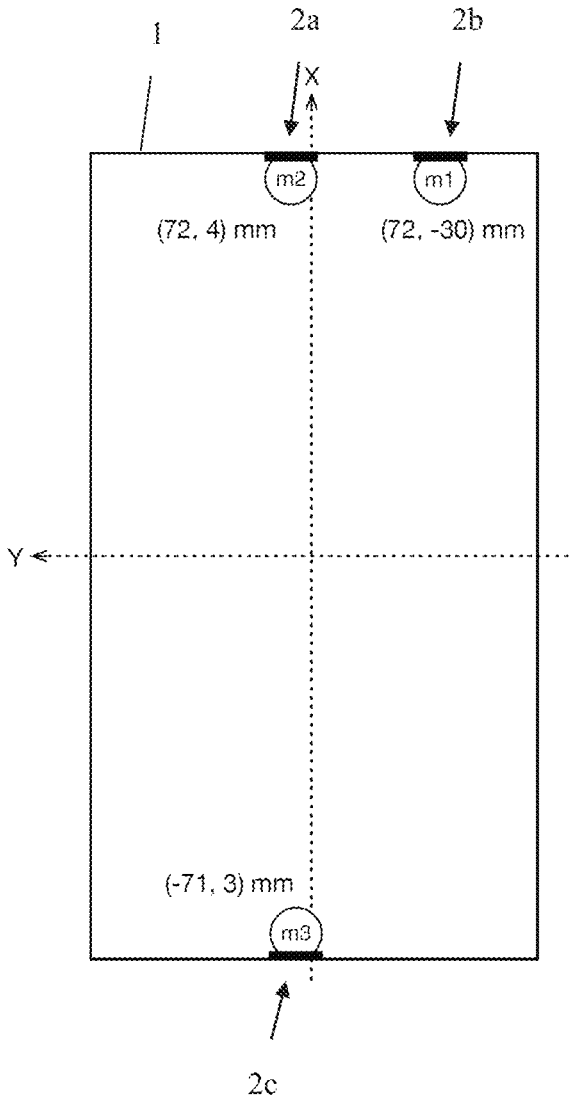
FIG. 4 shows a third embodiment of the audio recording device according to the second aspect of the present disclosure.

In FIG. 4, an example of an audio recording device 1 is shown in a two-dimensional diagram. The three microphones 2*a*, 2*b*, 2*c* are depicted in their actual physical location.

The following algorithm aims at estimating the angle of incidence of direct sound based on cross-correlation between both recorded microphone signals $x_1$ and $x_2$, and derives parametrically gain filters to generate beams focusing in specific directions.

A phase estimation, between both recording microphones, is carried out at each time-frequency tile. The microphone time-frequency representations, $X_1$ and $X_2$, of the microphone signals, are obtained using a $N_{STFT}$ points short-time Fourier transform (STFT). The delay relation between the two microphones can be derived from the cross-spectrum:

$$X_{12}[k,i]=\alpha_X X_1[k,i]X^*_2[k,i]+(1-\alpha_X)X_{12}[k-1,i], \tag{2}$$

where * denotes the complex conjugate operator. And $a_x$ is determined by:

$$\alpha_X = \frac{N_{STFT}}{T_X f_s}, \tag{3}$$

where $T_X$ is an averaging time-constant in seconds and $f_s$ is the sampling frequency. The phase response is defined as the angle of the complex cross-spectrum $X_{12}$, derived as the ratio between the imaginary and the real part of it:

$$\tilde{\psi}_{12}[k,i] = \arctan j\frac{X_{12}[k,i]X^*_{12}[k,i]}{X_{12}[k,i]+X^*_{12}[k,i]}, \tag{4}$$

where j is the imaginary unit, that satisfies $j^2=-1$.

Unfortunately, analogous to the Nyquist frequency in temporal sampling, a microphone array has a restriction on the minimum spatial sampling rate. Using two microphones, the smallest wavelength of interest is given by:

$$\lambda_{alias}=2d_{mic} \tag{5}$$

corresponding to a maximum frequency, $$f_{alias} = \frac{c}{\lambda_{alias}}, \tag{6}$$

up to which the phase estimation is unambiguous. Above this frequency, the measured phase is still obtained following (4) but with an uncertainty term related to an integer l modulo of $2\pi$:

$$\tilde{\psi}_{12}[k,i]=\psi_{12}[k,i]+2\pi\cdot l[i]. \tag{7}$$

Because the maximum travelling time between the two microphones of the array is given by $d_{mic}/c$, the bounds of integer l is defined by:

$$l[i] \le L[i] = \frac{id_{mic}f_s}{c\left(\frac{N_{STFT}}{2}+1\right)}, \tag{8}$$

A high frequency extension is provided based in equation (8) to constrain an unwrapping algorithm. The unwrapping aims at correcting the phase angle $\tilde{\psi}_{12}[k,i]$ by adding a multiple l[k,i] of $2\pi$ when absolute jump between the two consecutive elements, $|\tilde{\psi}_{12}[k,i]-\tilde{\psi}_{12}[k,i-1]|$, are greater than or equal to the jump tolerance of $\pi$. The estimated unwrapped phase $\psi_{12}$ is obtained by limiting the multiples l to their physical possible values. Eventually, even if the phase is aliased at high-frequency, its slope still follows the same principles as the delay estimation at low frequency. For the purpose of delay estimation, it is then sufficient to integrate the unwrapped phase $\psi_{12}$ over a number of frequency bins in order to derive its slope for later delay $$\Psi_{12}[k, i] = \frac{1}{2N_{hf}} \sum_{j=-N_{hf}}^{N_{hf}} \psi_{12}[k, i+j], \tag{9}$$

where $N_{hf}$ stands for the frequency bandwidth on which the phase is integrated.

For each frequency bin i, dividing by the corresponding physical frequency, the delay $\delta_{12}[k,i]$, expressed in number of samples, is obtained from the previously derived phase:

$$\delta_{12}[k,i]=(N_{STFT}/2+1)/(i\pi)\psi_{12}[k,i] \text{ if } i \leq i_{alias}$$

otherwise:

$$\delta_{12}[k,i]=(N_{STFT}/2+1)/(i\pi)\Psi_{12}[k,i], \tag{10}$$

where $i_{alias}$ is the frequency bin corresponding to the aliasing frequency (1). The delay in second is:

$$\tau_{12}[k, i] = \frac{\delta_{12}[k, i]}{f_s}. \tag{11}$$

The derived delay relates directly to the angle of incidence of sound emitted by a sound source, as illustrated in FIG. 2. Given the travelling time delay between both microphones, the resulting angle of incidence $\theta_{12}[k,i]$ is:

$$\theta_{12}[k, i] = \arcsin\left(\frac{c\ \tau_{12}[k, i]}{d_{mic}}\right), \tag{12}$$

with $d_{mic}$ the distance between both microphones and c the celerity of sound in the air.

In free-field, for direct sound, the directional response of a cardioid microphone pointing on the side of the array, is built as a function of the estimated angle of incidence:

$$D[k, i] = \frac{1}{2}\left(1 + \cos\left(\theta_{12}[k, i] - \frac{\pi}{2}\right)\right). \tag{13}$$

By applying the gain D to the input spectrum $X_1$, a virtual cardioid signal can be retrieved from the direct sound of the input microphone signals. This corresponds to the function of the beam estimator 12.

Figure 5:
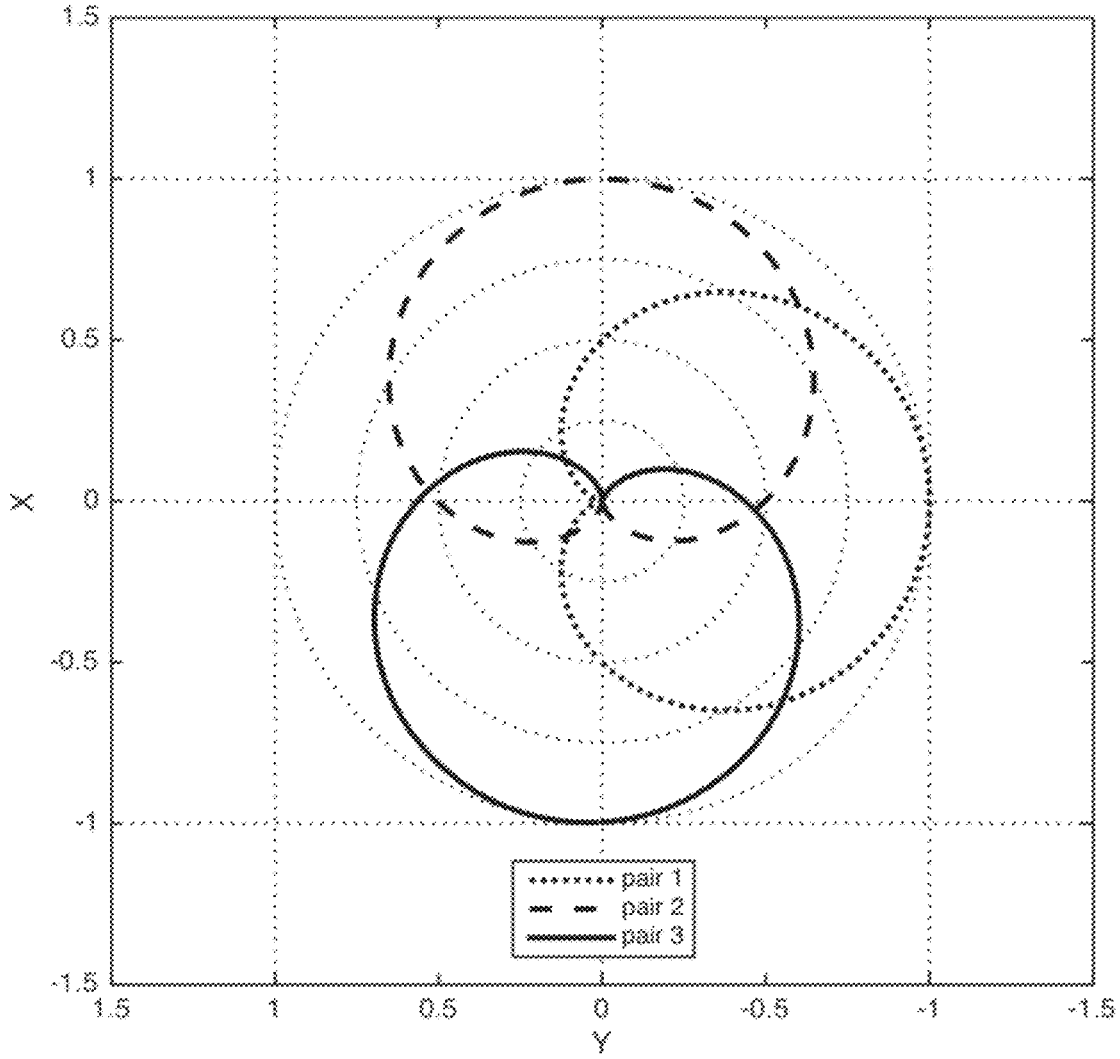
FIG. 5 shows A-format direct sound signals in a two-dimensional diagram.

In FIG. 5, three cardioid signals based upon three microphone pairs are depicted in a two-dimensional diagram, showing the respective gains.

Figure 6:
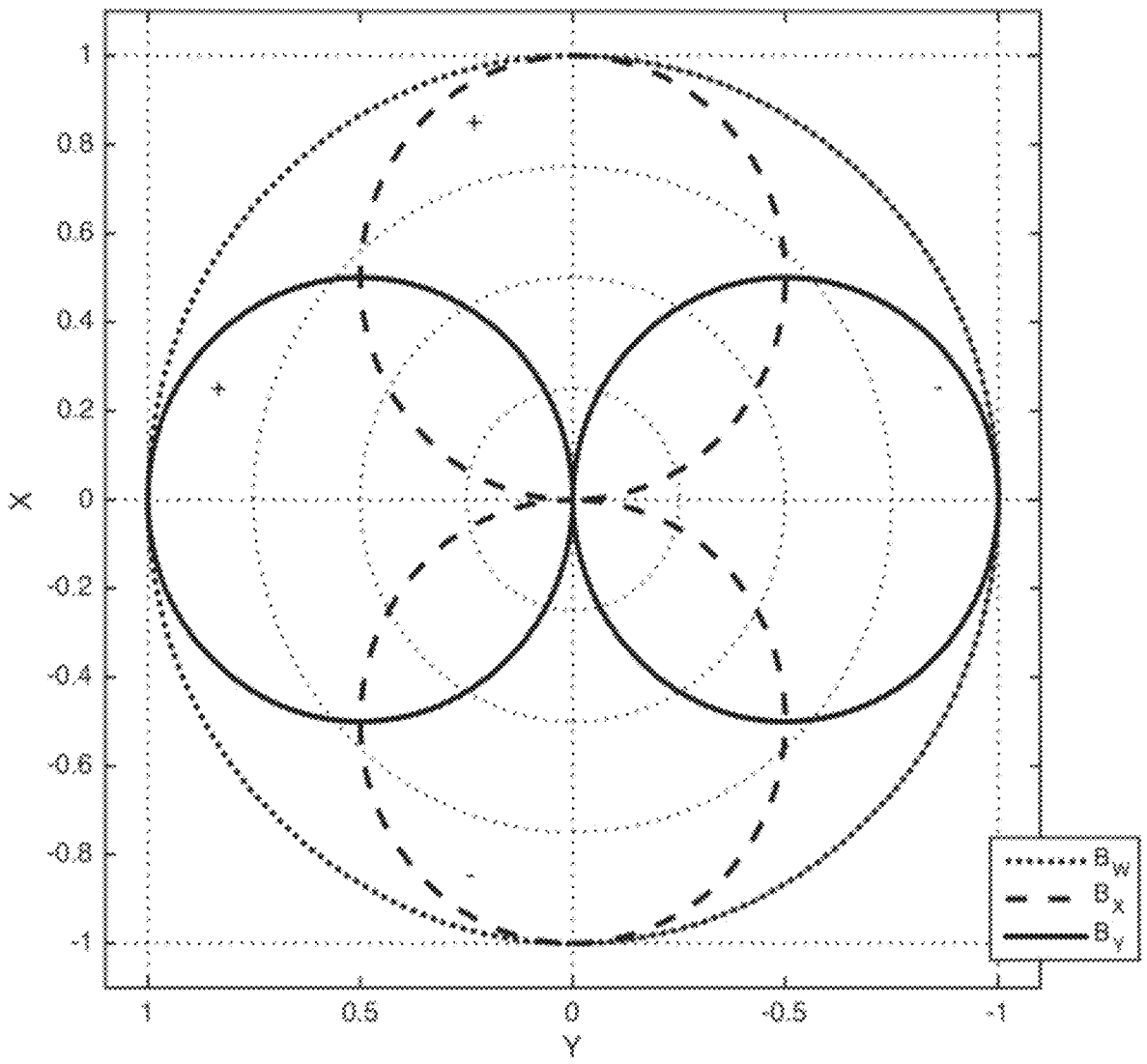
FIG. 6 shows B-format direct sound signals in a two-dimensional diagram.

In FIG. 6, the gains of B-format ambisonic direct sound signals are shown in a two-dimensional diagram.

In the following, the conversion from A-format direct sound signals to B-format direct sound signals is shown. This corresponds to the function of the encoder 13.

In the following Table are listed the Ambisonic B-format channels and their spherical representation $D(\theta,\phi)$ up to third-order, normalized with the Schmidt semi-normalization (SN3D), where θ and ϕ are, respectively, the azimuth and elevation angles:

| Order | Channel | SN3D Definition: $D(\theta, \phi)$ = |
|---|---|---|
| 0 | W | 1 |
| 1 | X | $\cos\theta\cos\phi$ |
| | Y | $\sin\theta\cos\phi$ |
| | Z | $\sin\phi$ |
| 2 | R | $(3\sin^2\phi - 1)/2$ |
| | S | $\sqrt{3/2}\cos\theta\sin2\phi$ |
| | T | $\sqrt{3/2}\sin\theta\sin2\phi$ |
| | U | $\sqrt{3/2}\cos2\theta\cos^2\phi$ |
| | V | $\sqrt{3/2}\sin2\theta\cos^2\phi$ |
| 3 | K | $\sin\phi(5\sin^2\phi - 3)/2$ |
| | L | $\sqrt{3/8}\cos\theta\cos\phi(5\sin^2\phi - 1)$ |
| | M | $\sqrt{3/8}\sin\theta\cos\phi(5\sin^2\phi - 1)$ |
| | N | $\sqrt{15/2}\cos2\theta\sin\phi\cos^2\phi$ |
| | O | $\sqrt{15/2}\sin2\theta\sin\phi\cos^2\phi$ |
| | P | $\sqrt{5/8}\cos3\theta\cos^3\phi$ |
| | Q | $\sqrt{5/8}\sin3\theta\cos^3\phi$ |

These spherical harmonics form a set of orthogonal basis functions and can be used to describe any function on the surface of a sphere.

Without loss of generality, three, the minimum number of, microphones are considered and placed in the horizontal XY-plane, for instance disposed at the edges of a mobile device as illustrated in FIG. 3, having the coordinates $(x_{m_1}, y_{m_1})$, $(x_{m_2}, y_{m_2})$, and $(x_{m_3}, y_{m_3})$.

The three possible unordered microphone pairs are defined as:

pair 1Δ=mic2→mic1 pair 2Δ=mic3→mic2 pair 3Δ=mic1→mic3

The look direction (Θ=0) being defined by the X-axis, their direction vectors are:

$$v_{p_1} = \begin{pmatrix} x_{m_1} \\ y_{m_1} \end{pmatrix} - \begin{pmatrix} x_{m_2} \\ y_{m_2} \end{pmatrix}, \tag{14}$$

$$v_{p_2} = (x_{m_2}, y_{m_2}) - \begin{pmatrix} x_{m_3} \\ y_{m_3} \end{pmatrix},$$

and $$v_{p_3} = \begin{pmatrix} x_{m_3} \\ y_{m_3} \end{pmatrix} - (x_{m_1}, y_{m_1}).$$

The direction for each of the pair in the horizontal plane are:

$$\forall n \in [1..3],\ \theta_{p_n} = \arctan\left(\frac{y_{v_{p_n}}}{x_{v_{p_n}}}\right). \tag{15}$$

And the microphone spacing:

$$\forall n \in [1..3],\ \partial_{p_n} = \sqrt{x_{v_{p_n}}^2 + y_{v_{p_n}}^2}. \tag{16}$$

The gain (13) resulting from the angle of incidence estimation is applied to each pair leading to cardioid directional responses:

$$\forall n \in [1 \ldots 3], A_{p_n}[k,i]=D_{p_n}[k,i]X_1[k,i]. \tag{17}$$

The three resulting cardioids are pointing in the three directions $\theta_{p_1}$, $\theta_{p_2}$, and $\theta_{p_3}$, defining the corresponding A-format representation, as illustrated in FIG. 4.

Assuming that the obtained cardioids are coincident, the corresponding first order Ambisonic B-format signals can be computed by means of linear combination of the spectra $A_{p_n}$, The conversion from Ambisonic B-format to A-format is implemented as:

$$\begin{bmatrix} A_{p_1} \\ A_{p_2} \\ A_{p_3} \end{bmatrix} = \Gamma \begin{bmatrix} R_W \\ R_X \\ R_Y \end{bmatrix} = \frac{1}{2} \begin{bmatrix} 1 & \cos\theta_{p_1} & \sin\theta_{p_1} \\ 1 & \cos\theta_{p_2} & \sin\theta_{p_2} \\ 1 & \cos\theta_{p_3} & \sin\theta_{p_3} \end{bmatrix} \begin{bmatrix} R_W \\ R_X \\ R_Y \end{bmatrix} \tag{18}$$

The inverse matrix of (18) enables to convert the cardioids to Ambisonic B-format, $$\begin{bmatrix} R_W \\ R_X \\ R_Y \end{bmatrix} = \Gamma^{-1} \begin{bmatrix} A_{p_1} \\ A_{p_2} \\ A_{p_3} \end{bmatrix} \tag{19}$$

The first order Ambisonic B-format normalized directional responses $R_W$, $R_X$, and $R_Y$, are shown in FIG. 5, where $R_W$ corresponds to a monopole. while the signals $R_X$ and $R_Y$ correspond to two orthogonal dipoles.

In the following, the determining of higher order ambisonic B-format signals is shown. This corresponds to the function of the direction-of-arrival estimator 20 and the higher order ambisonic encoder 21.

Deriving previously, the first order ambisonic B-format signals $R_W$, $R_X$, and $R_Y$ for the direct sound, no explicit direction of arrival (DOA) of sound was computed. Instead the directional responses of the three signals $R_W$, $R_X$, and $R_Y$ have been obtained from the A-format cardioid signals $A_{p_n}$ in (17).

In order to obtain the higher order (e.g. second and third) ambisonic B-format signals, an explicit DOA is derived based on the two first order ambisonic B-format signals $R_X$ and $R_Y$ as:

$$\theta_{XY}[k, i] = \arctan\frac{R_Y[k, i]}{R_X[k, i]}. \tag{20}$$

Again, assuming three omnidirectional microphones in the horizontal plane ($\varphi=0$), the channels of interest as defined in the ambisonic definition in the Table are limited to:

order 0: W
order 1: X, Y
order 2: R, U, V
order 3: L, M, P, Q

The other channels are null since they are modulated by $\sin\varphi$, with $\varphi=0$. For each of the above listed channels the directional responses are thus derived by substituting the azimuth angle $\Theta$ by the estimated DOA $\Theta_{XY}$. For instance, considering second order (assuming no elevation, i.e. $\varphi=0$):

$$R_R \triangleq (3\sin^2\phi - 1)/2 = -1/2 \tag{21}$$

$$R_S \triangleq \sqrt{3}/2\cos\theta\sin 2\phi = 0$$

-continued $$R_T \triangleq \sqrt{3}/2\sin\theta\sin 2\phi = 0$$

$$R_U \triangleq \sqrt{3}/2\cos 2\theta\cos^2\phi = \sqrt{3}/2\cos 2\theta_{XY}$$

$$R_V \triangleq \sqrt{3}/2\sin 2\theta\cos^2\phi = \sqrt{3}/2\sin 2\theta_{XY}$$

The resulting ambisonic channels, $R_R$, $R_U$, $R_V$, $R_L$, $R_M$, $R_P$, and $R_Q$, contain only the direct sound components of the sound field.

Now, the handling of diffuse sound is shown. This corresponds to the diffuse sound estimator 31 and the decorrelation filter bank 32 of FIG. 2.

Figure 7:
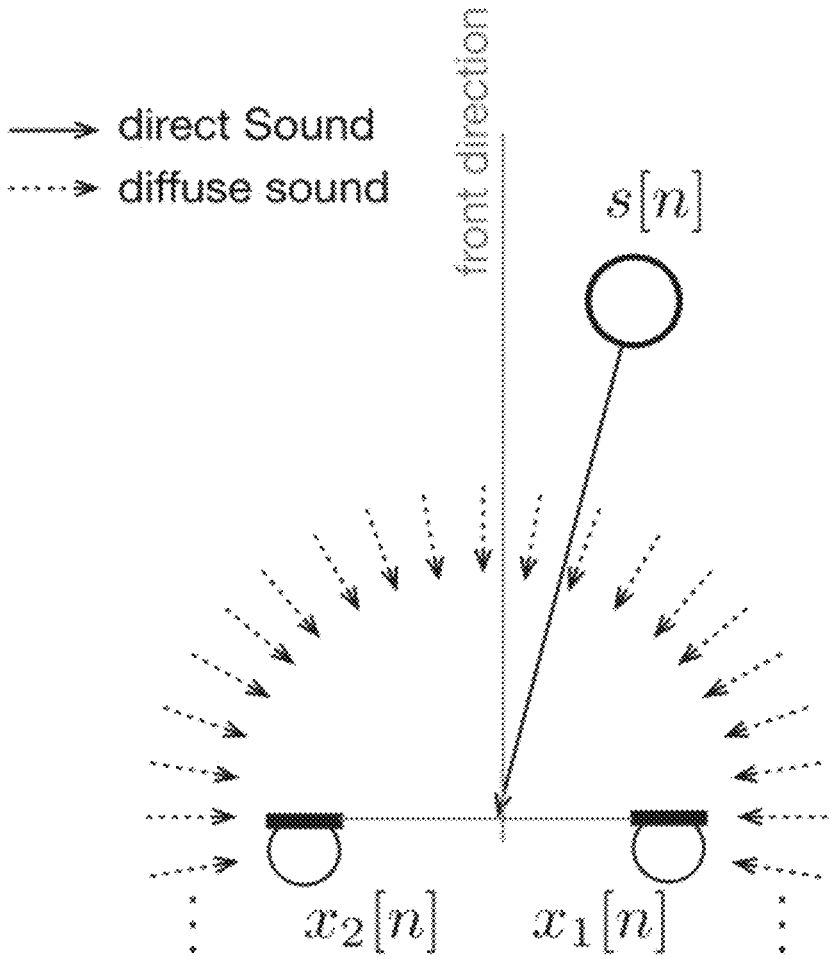
FIG. 7 shows diffuse sound received by two microphones.

In FIG. 7, the occurrence of direct sound from a sound source and omnidirectional diffuse sound is shown in a diagram depicting the locations of two microphones.

Figure 8:
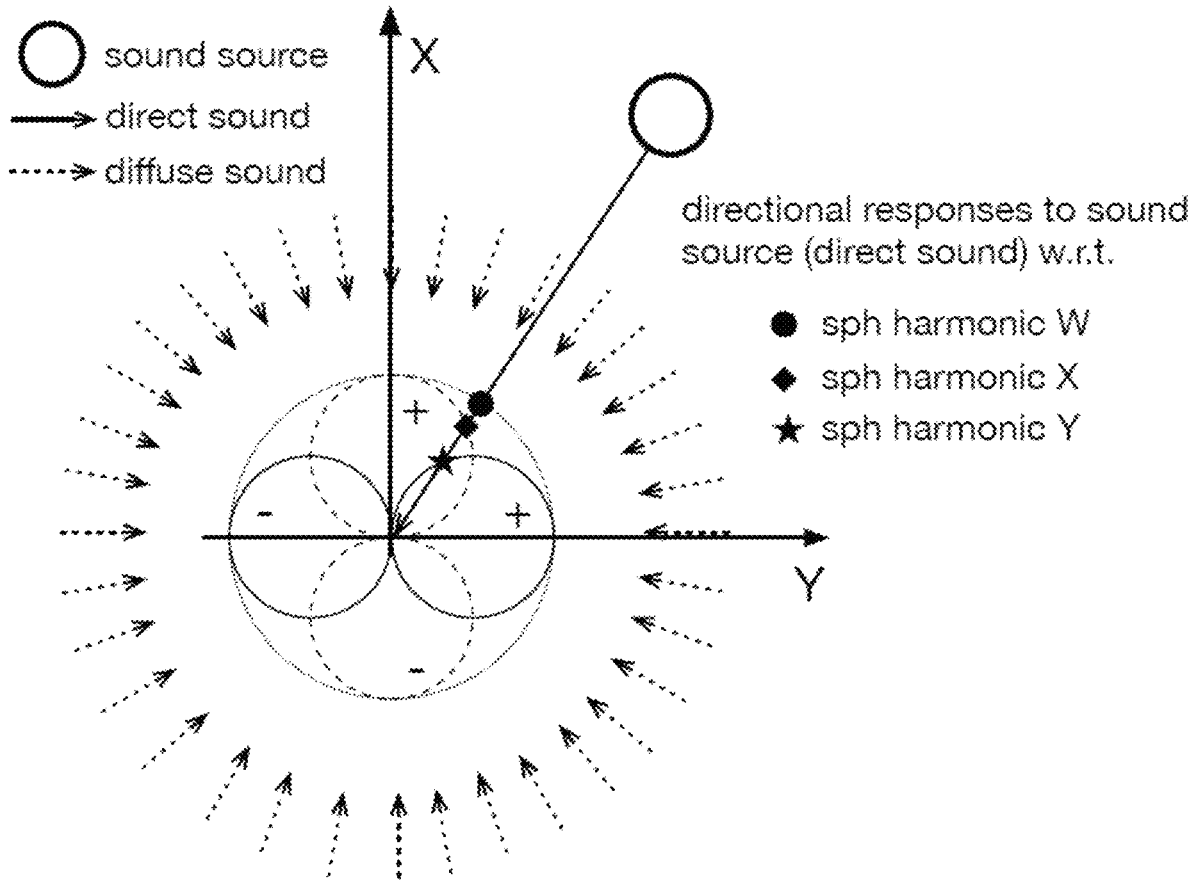
FIG. 8 shows direct sound and diffuse sound in a two-dimensional diagram.

In FIG. 8, the directional responses to a sound source of direct sound is shown. Additionally, omnidirectional diffuse sound is depicted.

The previous derivation of the ambisonic B-format signals is only valid under the assumption of direct sound. It does not hold for diffuse sound. In the following a method for obtaining an equivalent diffuse sound for Ambisonic B-format signals is given. Considering enough time after the direct sound and a number of early reflections, numerous reflections are themselves reflected in the space creating a diffuse sound field. By diffuse sound field is mathematically understood as independent sounds having the same energy and coming from all directions, as illustrated in FIG. 7.

It is assumed that $X_1$ and $X_2$ can be modelled as:

$$X_1[k,i]=S[k,i]+N_1[k,i],$$

$$X_2[k,i]=a[k,i]S[k,i]+N_2[k,i], \tag{22}$$

where a[k,i] is a gain factor, S[k,i] is the direct sound in the left channel, and $N_1[k,i]$ and $N_2[k,i]$ represent diffuse sound. From (22) it follows that:

$$E\{X_1X^*_1\}=E\{SS^*\}+E\{N_1N^*_1\}$$

$$E\{X_2X^*_2\}=a^2E\{SS^*\}+E\{N_2N^*_2\}$$

$$E\{X_1X^*_2\}=aE\{SS^*\}+E\{N_1N^*_2\}. \tag{23}$$

It is reasonable to assume that the amount of diffuse sound in both microphone signals is the same, i.e. $E\{N_1N^*_1\}=E\{N_2N^*_2\}=E\{NN^*\}$. Furthermore, the normalized cross-correlation coefficient between $N_1$ and $N_2$ is denoted $\Phi_{diff}$ and can be obtained from the Cook's, $$\Phi_{diff}[i] = \frac{\sin D}{D} \text{ with } D = \frac{2\pi i f_s d_{mic}}{c N_{STFT}}. \tag{24}$$

Eventually (23) can be re-written as $$E\{X_1X^*_1\}=E\{SS^*\}+E\{NN^*\}$$

$$E\{X_2X^*_2\}=a^2E\{SS^*\}+E\{NN^*\}$$

$$E\{X_1X^*_2\}=aE\{SS^*\}+\Phi_{diff}E\{NN^*\}. \tag{25}$$

Elimination of E{SS*} and a in (25) yields the quadratic equation:

$$AE\{NN^*\}^2+BE\{NN^*\}+C=0 \tag{26}$$

with $$A=1-\Phi_{diff}^2,$$

$$B=2\Phi_{diff}E\{X_1X^*_2\}-E\{X_1X^*_1\}-E\{X_2X^*_2\},$$

$$C=E\{X_1X^*_1\}E\{X_2X^*_2\}-E\{X_1X^*_2\}^2. \tag{27}$$

The power estimate of diffuse sound, denoted $P_{diff}$, is then one of the two solutions of (26), the physically possible one (the other solution of (26), yielding a diffuse sound power larger than the microphone signal power, is discarded, as it is physically impossible), i.e.:

$$P_{diff}[k,i]=E\{NN^*\}=\frac{-B-\sqrt{B^2-4AC}}{2A}. \tag{28}$$

Note that straightforwardly the contribution of the direct sound can be computed as:

$$P_{dir}[k,i]=P_{X_1}[k,i]-P_{diff}[k,i]. \tag{29}$$

This corresponds to the function of the diffuse sound estimator 31.

By definition the Ambisonic B-format signals are obtained by projecting the sound field unto the spherical harmonics basis defined in the previous table. Mathematically, the projection corresponds to the integration of the sound field signal over the spherical harmonics.

As illustrated in FIG. 7, due to the orthogonality property of the spherical harmonics basis: projecting mathematically independent sounds from all directions unto this basis will result in three orthogonal components:

$$D_W \perp D_X \perp D_Y. \tag{30}$$

Note that this property does not hold anymore for direct sound, since a sound source emitting from only ne direction projected unto the same basis will result in a single gain equal to the directional responses at the incidence angle of the sound source, leading to non-orthogonal, or in other terms, correlated components $R_W$, $R_X$, and $R_Y$.

However, here, considering a distribution of three omnidirectional microphones, the single diffuse sound estimate (28) is equivalent for all three microphones (or all three microphone pairs). Therefore there is no possibility to retrieve the native diffuse sound components of the Ambisonic B-format signals, i.e. $D_W$, $D_X$, and $D_Y$ as they would be obtained separately by projection of the diffuse sound field unto the spherical harmonics basis.

Instead of getting the exact diffuse sound Ambisonic B-format signals, an alternative is to generate three orthogonal diffuse sound components from the single known diffuse sound estimate $P_{diff}$. This way, even if the diffuse sound components do not correspond to the native Ambisonic B-format obtained by projection, the most perceptually important property of orthogonality (enabling localization and spatialization) is preserved. This can be achieved by using de-correlation filters.

The de-correlation filters are derived from a Gaussian noise sequence u of given length $l_u$. A Gram-Schmidt process applied to this sequence leads to $N_u$ orthogonal sequences $U_1$, $U_2$, Λ, $U_{N_u}$ which serve as filters to generate $N_u$ orthogonal diffuse sounds. In the three microphones case described previously ($N_u$=3):

Given the length $l_u$ of the noise Gaussian noise sequence u, the de-correlation filters are shaped such that they have an exponential decay over time, similarly as reverberation is a room. To do so, the sequences $U_1$, $U_2$, Λ, $U_N$ are multiplied with an exponential window $w_u$ with a time constant corresponding to the reverberation time $RT_{60}$:

$$w_u[n]=\exp\left(-\frac{0.5\ \ln 1e6\ |n|}{f_s RT_{60}}\right) \text{ with } -l_u<n<l_u. \tag{31}$$

Figure 9:
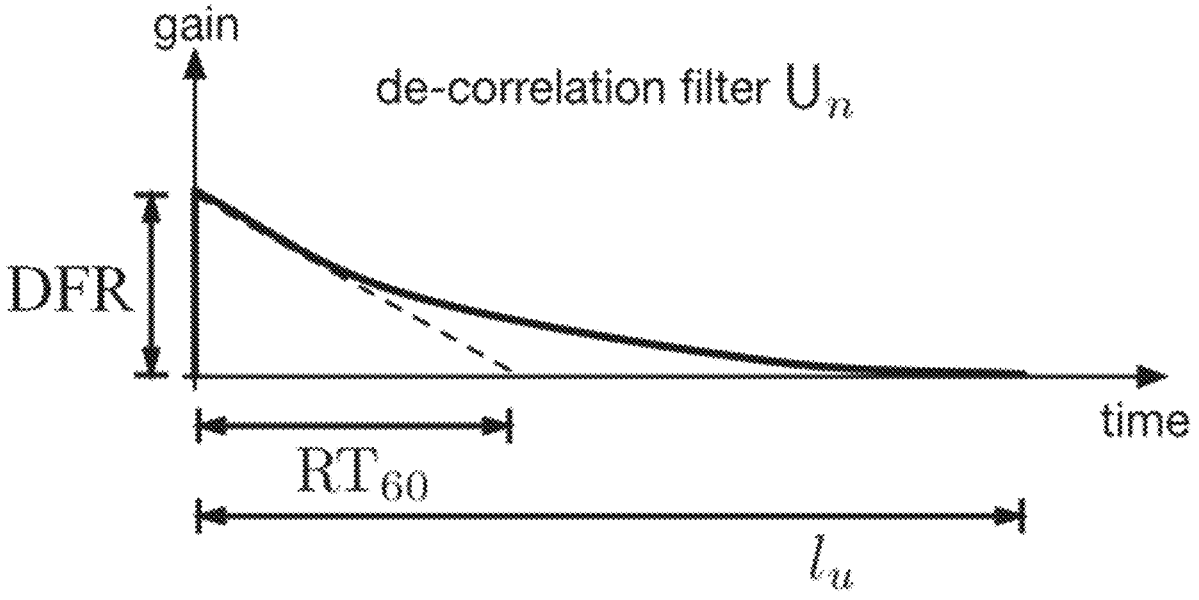
FIG. 9 shows an example of a de-correlation filter, as used by an audio encoding device according to a fourth embodiment of the first aspect.

In FIG. 9, the filter response of a filter of the de-correlation filter bank 32 of FIG. 2 is shown. Especially the time constant of such a filter is depicted.

The exponential decay of the de-correlation filters, illustrated in FIG. 9, will directly have an influence on the diffuse sound components in the B-format signals. A long decay will over emphasize the diffuse sound contribution in the final B-format but will ensure better separation between the three diffuse sound components.

Eventually, the resulting de-correlation filters are modulated by the diffuse-field responses of the ambisonic B-format channels they correspond to. This way the amount of diffuse sound in each ambisonic B-format channel matches the amount of diffuse sound of a natural B-format recording. The diffuse-field response DFR is the average of the corresponding spherical harmonic directional-response-squared contributions considering all directions, i.e.:

$$DFR=\frac{1}{4\pi}\int_{-\frac{\pi}{2}}^{\frac{\pi}{2}}\int_{-\pi}^{\pi}|D(\theta,\phi)|^2\cos\phi\ d\theta\ d\phi. \tag{32}$$

In the three microphones case ($N_u$=3), the resulting de-correlations filters are:

$$\tilde{D}_W[k,i]=\mathrm{DFR}_W w_u U_1 P_{2D\text{-}diff}[k,i],$$

$$\tilde{D}_X[k,i]=\mathrm{DFR}_X w_u U_2 P_{2D\text{-}diff}[k,i],$$

$$\tilde{D}_Y[k,i]=\mathrm{DFR}_Y w_u U_3 P_{2D\text{-}diff}[k,i]. \tag{33}$$

This way, the orthogonality property between all three diffuse sounds being preserved any further processing using the generated B-format will work on diffuse sound too, i.e., using conventional ambisonic decoding.

Eventually both direct and diffuse sound contributions have to be mixed together in order to generate the full Ambisonic B-format. Given the assumed signal model, the direct and diffuse sounds are, by definition, orthogonal, too. Thus the complete Ambisonic B-format signal are obtained using a straightforward addition:

$$B_W[k,i]=R_W[k,i]+\tilde{D}_W[k,i],$$

$$B_X[k,i]=R_X[k,i]+\tilde{D}_X[k,i],$$

$$B_Y[k,i]=R_Y[k,i]+\tilde{D}_Y[k,i]. \tag{34}$$

This addition is performed by the adder 40 of FIG. 2.

After this addition, only the inverse short-time Fourier transformation by the inverse short-time Fourier transformer 41 is performed in order to achieve the output B-format ambisonic signals.

Figure 10:
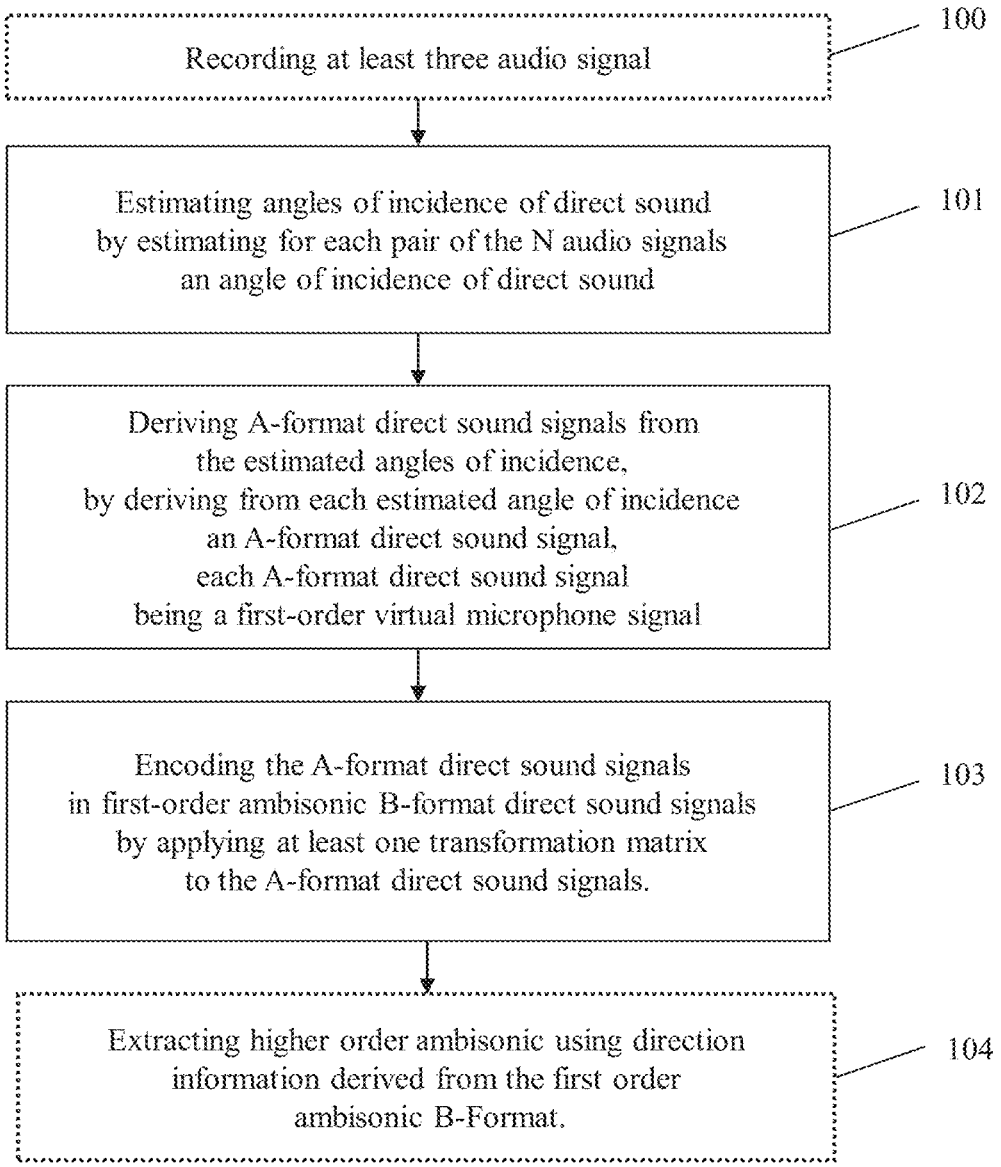
FIG. 10 shows an embodiment of the third aspect of the present disclosure in a flow diagram.

Finally, in FIG. 10, an embodiment of the audio encoding method according to the third aspect of the present disclosure is shown. In a first optional step 100 at least 3 audio signals are recorded. In a second step 101, angles of incidence of direct sound are estimated, by estimating for each pair of the N audio signals an angle of incidence of direct sound. In a third step 102, A-format direct sound signals are derived from the estimated angles of incidence, by deriving from each estimated angle of incidence an A-format direct sound signal, each A-format direct sound signal being a first-order virtual microphone signal. In a fourth step 103, the ambisonic A-format direct sound signals are encoded to first-order ambisonic B-format direct sound signals by applying at least one transformation matrix to the A-format direct sound signals. Note that the fourth step of performing the encoding is an optional step with regard to the third aspect of the present disclosure. In a further optional fifth step 104, a higher order ambisonic B-Format signal is generated based on direction of arrival derived from first order B-Format.

Note that the audio encoding device according to the first aspect of the present disclosure as well as the audio recording device according to the second aspect of the present disclosure relate very closely to the audio encoding method according to the third aspect of the present disclosure. Therefore, the elaborations along FIG. 1-9 are also valid with regard to the audio encoding method shown in FIG. 10.

These encoded signals are fully compatible with conventional Ambisonic B-format signals, and thus, can be used as input for Ambisonic B-format decoding or any other processing. The same principle can be applied to retrieve full higher order Ambisonic B-format signals with both direct and diffuse sounds contributions.

Abbreviations and Notations

| Abbreviation | Definition |
|---|---|
| VR | Virtual Reality |
| DirAc | Directional Audio Coding |
| DOA | Direction Of Arrival |
| STFT | short-Time Fourier Transform |
| SN3D | Schmidt semi-Normalization 3D |
| DFR | Diffuse-Field Response |
| SNR | Signal to Noise Ratio |
| HOA | High Order Ambisonic |

| Notation | Definition |
|---|---|
| $x_{1,x2}$ | Both recorded microphone signals |
| $X_1[k, i]$ | STFT of $x_1$ in frame k and frequency bin i |
| S[k, i] | STFT of source signal |
| $N_1[k, i]$ | Diffuse noise in microphone 1 |
| $\alpha_X$ | Forgeting factor |
| $T_X$ | averaging time-constant |
| $X_{12}$ [k, i] | cross-spectrum two microphone signal 1 and 2 |
| $f_s$ | sampling frequency |
| $f_{alias}$ | Frequency aliasing |
| $d_{mic}$ | Distance between both microphones |
| E { } | Expectation oparator |
| θ and ϕ | azimuth and elevation angles |
| $P_{diff}$ | power estimate of diffuse noise |
| $R_W$, $R_X$, $R_Y$ | First order Ambisonic components |
| $R_R$, $R_U$, $R_V$, $R_L$, $R_M$, $R_P$, and $R_Q$ | Higher order Ambisonic components |
| $P_{2D\text{-}diff}$ | power estimate of diffuse noise in 2D |
| $U_1$, $U_2$, Λ, $U_{N_u}$ | Orthogonal sequences |
| $\tilde{\psi}_{12}$ | Angle of the complex cross-spectrum $X_{12}$ |
| $\Psi_{12}$ | The mean of unwrapped phase $\psi_{12}$ over frequency aliasing |
| l[i] | An uncertainty integer which depends on frequency i |
| L[i] | Upper bound function for l[i] which depends on frequency i |

-continued

| Notation | Definition |
|---|---|
| D(θ, ϕ) | Spherical representation of the Ambisonic channels |
| $A_{P1}$, $A_{P2}$, $A_{P3}$, . . . , $A_{Pn}$ | The cardioids that each of them generated with pair of microphones |
| $RT_{60}$ | Reverberation time |
| $l_u$ | Length of Gaussian noise sequence u |
| $w_u$ | Exponential window |
| $DFR_W$, $DFR_X$, $DFR_Y$ | Diffuse-Field Responses for W, X, Y components |

The present disclosure is not limited to the examples and especially not to a specific number of microphones. The characteristics of the exemplary embodiments can be used in any advantageous combination.

The present disclosure has been described in conjunction with various embodiments herein. However, other variations to the disclosed embodiments can be understood and effected by those skilled in the art in practicing the claimed invention, from a study of the drawings, the disclosure and the appended claims. In the claims, the word "comprising" does not exclude other elements or steps and the indefinite article "a" or "an" does not exclude a plurality. A single processor or other unit may fulfill the functions of several items recited in the claims. The mere fact that certain measures are recited in usually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the internet or other wired or wireless communication systems.

What is claimed is:

1. An audio encoding device, for encoding N audio signals, from N microphones where N≥3, the audio encoding device comprising:

a delay estimator configured to estimate angles of incidence of direct sound by estimating, for each pair of the N audio signals, an angle of incidence of the direct sound, and a beam deriver configured to derive A-format direct sound signals from the estimated angles of incidence by deriving, from each of the estimated angles of incidence, a respective one of the A-format direct sound signals, each of the A-format direct sound signals being a first-order virtual microphone signal; and an encoder configured to encode the A-format direct sound signals in first-order ambisonic B-format direct sound signals by applying a transformation matrix to the A-format direct sound signals, wherein N=3, wherein the audio encoding device comprises a short time Fourier transformer configured to perform a short time Fourier transformation on each of the N audio signals $x_1$, $x_2$, $x_3$, resulting in N short time Fourier transformed audio signals $X_1[k,i]$, $X_2[k,i]$, $X_3[k,i]$, wherein the delay estimator is configured to:

determine cross spectra of each pair of the short time Fourier transformed audio signals according to:

$$X_{12}[k,i]=\alpha_X X_1[k,i]X^*_2[k,i]+(1-\alpha_X)X_{12}[k-1,i],$$

$$X_{13}[k,i]=\alpha_X X_1[k,i]X^*_3[k,i]+(1-\alpha_X)X_{13}[k-1,i], \text{ and}$$

$$X_{23}[k,i]=\alpha_X X_2[k,i]X^*_3[k,i]+(1-\alpha_X)X_{23}[k-1,i],$$

determine an angle of the complex cross spectrum of each pair of the short time Fourier transformed audio signals according to:

$$\tilde{\psi}_{12}[k, i] = \arctan j\frac{X_{12}[k, i]X_{12}^*[k, i]}{X_{12}[k, i] + X_{12}^*[k, i]},$$

$$\tilde{\psi}_{13}[k, i] = \arctan j\frac{X_{13}[k, i]X_{13}^*[k, i]}{X_{13}[k, i] + X_{13}^*[k, i]}, \text{ and}$$

$$\tilde{\psi}_{23}[k, i] = \arctan j\frac{X_{23}[k, i]X_{23}^*[k, i]}{X_{23}[k, i] + X_{23}^*[k, i]},$$

perform a phase unwrapping to $\tilde{\psi}_{12}$, $\tilde{\psi}_{13}$, $\tilde{\psi}_{23}$, resulting in $\psi_{12}$, $\psi_{13}$, $\psi_{23}$, estimate the delay in number of samples according to:

$$\delta_{12}[k,i]=(N_{STFT}/2+1)/(i\pi)\psi_{12}[k,i],$$

$$\delta_{13}[k,i]=(N_{STFT}/2+1)/(i\pi)\psi_{13}[k,i], \text{ and}$$

$$\delta_{23}[k,i]=(N_{STFT}/2+1)/(i\pi)\psi_{23}[k,i], \text{ if } i\leq i_{alias}$$

or $$\delta_{12}[k,i]=(N_{STFT}/2+1)/(i\pi)\Psi_{12}[k,i],$$

$$\delta_{13}[k,i]=(N_{STFT}/2+1)/(i\pi)\Psi_{13}[k,i], \text{ and}$$

$$\delta_{23}[k,i]=(N_{STFT}/2+1)/(i\pi)\Psi_{23}[k,i], \text{ if } i>i_{alias}$$

estimate the delay in seconds according to:

$$\tau_{12}[k, i] = \frac{\delta_{12}[k, i]}{f_s},$$

$$\tau_{13}[k, i] = \frac{\delta_{13}[k, i]}{f_s}, \text{ and}$$

$$\tau_{23}[k, i] = \frac{\delta_{23}[k, i]}{f_s},$$

and estimate the angles of incidence according to:

$$\theta_{12}[k, i] = \arcsin\left(\frac{c\ \tau_{12}[k, i]}{d_{mic}}\right),$$

$$\theta_{13}[k, i] = \arcsin\left(\frac{c\ \tau_{13}[k, i]}{d_{mic}}\right), \text{ and}$$

$$\theta_{23}[k, i] = \arcsin\left(\frac{c\ \tau_{23}[k, i]}{d_{mic}}\right),$$

and wherein:

$x_1$ is a first audio signal of the N audio signals, $x_2$ is a second audio signal of the N audio signals, $x_3$ is a third audio signal of the N audio signals, $X_1$ is a first short time Fourier transformed audio signal of the short time Fourier transformed audio signals, $X_2$ is a second short time Fourier transformed audio signal of the short time Fourier transformed audio signals, $X_3$ is a third short time Fourier transformed audio signal of the short time Fourer transformed audio signals, k is a frame of the short time Fourier transformed audio signals, and i is a frequency bin of the short time Fourier transformed audio signals, $X_{12}$ is a cross spectrum of a pair of $X_1$ and $X_2$, $X_{13}$ is a cross spectrum of a pair of $X_1$ and $X_3$, $X_{23}$ is a cross spectrum of a pair of $X_2$ and $X_3$, $\alpha_X$ is a forgetting factor, $X^*$ is a conjugate complex of X, j is the imaginary unit, $\tilde{\psi}_{12}$ is an angle of the complex cross spectrum of $X_{12}$, $\tilde{\psi}_{13}$ is an angle of the complex cross spectrum of $X_{13}$, $\tilde{\psi}_{23}$ is an angle of the complex cross spectrum of $X_{23}$, $i_{alias}$ is a frequency bin corresponding to an aliasing frequency, $f_s$ is a sampling frequency, $d_{mic}$ is a distance of the microphones, and c is the speed of sound.

2. The audio encoding device according to claim 1, wherein the beam deriver is configured to:

determine cardioid directional responses according to:

$$D_{12}[k, i] = \frac{1}{2}\left(1 + \cos\left(\theta_{12}[k, i] - \frac{\pi}{2}\right)\right),$$

$$D_{13}[k, i] = \frac{1}{2}\left(1 + \cos\left(\theta_{13}[k, i] - \frac{\pi}{2}\right)\right), \text{ and}$$

$$D_{13}[k, i] = \frac{1}{2}\left(1 + \cos\left(\theta_{23}[k, i] - \frac{\pi}{2}\right)\right),$$

and derive the A-format direct sound signals according to:

$$A_{12}[k,i]=D_{12}[k,i]X_1[k,i],$$

$$A_{13}[k,i]=D_{13}[k,i]X_1[k,i], \text{ and}$$

$$A_{23}[k,i]=D_{23}[k,i]X_1[k,i],$$

wherein:

D is a cardioid directional response, and

A is an A-format direct sound signal of the A-format direct sound signals.

3. The audio encoding device according to claim 2, wherein the encoder is configured to encode the A-format direct sound signals to the first-order ambisonic B-format direct sound signals according to:

$$\begin{bmatrix} R_W \\ R_X \\ R_Y \end{bmatrix} = \Gamma^{-1}\begin{bmatrix} A_{12} \\ A_{13} \\ A_{23} \end{bmatrix},$$

wherein:

$R_w$ is a first, zero-order ambisonic B-format direct sound signal, $R_x$ is a first, first-order ambisonic B-format direct sound signal among the first-order ambisonic B-format direct sound signals, $R_y$ is a second, first-order ambisonic B-format direct sound signal among the first-order ambisonic B-format direct sound signals, and $\Gamma^{-1}$ is the transformation matrix.

4. The audio encoding device according to claim 1, comprising a direction of arrival estimator configured to estimate a direction of arrival from the first-order ambisonic B-format direct sound signals, and a higher order ambisonic encoder configured to encode higher order ambisonic B-format direct sound signals using the first-order ambisonic B-format direct sound signals and the estimated direction of arrival, wherein higher order ambisonic B-format direct sound signals have an order higher than one.

5. The audio encoding device according to claim 4, wherein the direction of arrival estimator is configured to estimate the direction of arrival according to:

$$\theta_{XY}[k, i] = \arctan\frac{R_Y[k, i]}{R_X[k, i]},$$

and wherein $\theta_{XY}$ [k,i] is the direction of arrival of the direct sound of frame k and frequency bin i.

6. The audio encoding device according to claim 5, wherein the higher order ambisonic B-format direct sound signals comprise second order ambisonic B-format direct sound signals limited to two dimensions, wherein the higher order ambisonic encoder is configured to encode the second order ambisonic B-format direct sound signals according to:

$$R_R \triangleq (3\sin^2\phi - 1)/2 = -1/2,$$

$$R_S \triangleq \sqrt{3}/2\cos\theta\sin 2\phi = 0,$$

$$R_T \triangleq \sqrt{3}/2\sin\theta\sin 2\phi = 0,$$

$$R_U \triangleq \sqrt{3}/2\cos 2\theta\cos^2\phi = \sqrt{3}/2\cos 2\theta_{XY}, \text{ and}$$

$$R_V \triangleq \sqrt{3}/2\sin 2\theta\cos^2\phi = \sqrt{3}/2\sin 2\theta_{XY},$$

and wherein:

$R_R$ is a first, second-order ambisonic B-format direct sound signal among the second order ambisonic B-format direct signals, $R_S$ is a second, second-order ambisonic B-format direct sound signal among the second order ambisonic B-format direct signals, $R_T$ is a third, second-order ambisonic B-format direct sound signal among the second order ambisonic B-format direct signals, $R_U$ is a fourth, second-order ambisonic B-format direct sound signal among the second order ambisonic B-format direct signals, $R_V$ is a fifth, second-order ambisonic B-format direct sound signal among the second order ambisonic B-format direct signals, $\triangleq$ denotes "defined as", $\Phi$ is an elevation angle, and $\theta$ is an azimuth angle.

7. The audio encoding device according to claim 1, comprising a microphone matcher configured to perform a matching of the N frequency domain audio signals, resulting in N matched frequency domain audio signals.

8. The audio encoding device according to claim 7, comprising a diffuse sound estimator configured to estimate a diffuse sound power, and a de-correlation filter bank configured to perform a de-correlation of the diffuse sound power by generating three orthogonal diffuse sound components from the diffuse sound estimate power.

9. The audio encoding device according to claim 8, wherein the diffuse sound estimator is configured to estimate the diffuse sound power according to:

$$A = 1 - \Phi_{diff}^2,$$

$$B = 2\Phi_{diff}E\{X_1X_2^*\} - E\{X_1X_1^*\} - E\{X_2X_2^*\},$$

$$C = E\{X_1X_1^*\}E\{X_2X_2^*\} - E\{X_1X_2^*\}^2, \text{ and}$$

$$P_{diff}[k, i] = \frac{-B - \sqrt{B^2 - 4AC}}{2A},$$

wherein:

$P_{diff}$ is the diffuse sound power,

E{ } is an expectation value, $\Phi^2_{diff}$ is a normalized cross-correlation coefficient between $N_1$ and $N_2$, $N_1$ is diffuse sound in a first channel, and $N_2$ is diffuse sound in a second channel.

10. The audio encoding device according to claim 9, wherein the de-correlation filter bank is configured to perform the de-correlation of the diffuse sound power by generating three orthogonal diffuse sound components from the diffuse sound estimate power:

$$\tilde{D}_W[k,i] = DFR_W w_u U_1 P_{2D\text{-}diff}[k,i],$$

$$\tilde{D}_X[k,i] = DFR_X w_u U_2 P_{2D\text{-}diff}[k,i], \text{ and}$$

$$\tilde{D}_Y[k,i] = DFR_Y w_u U_3 P_{2D\text{-}diff}[k,i],$$

wherein:

$$DFR_a \triangleq \frac{1}{4\pi}\int_{-\frac{\pi}{2}}^{\frac{\pi}{2}}\int_{-\pi}^{\pi}|R_a(\theta, \phi)|^2 \cos\phi \, d\theta \, d\phi,$$

$$R_X(\theta, \phi) = \cos\phi \cos\theta,$$

$$R_Y(\theta, \phi) = \cos\phi \sin\theta,$$

$$R_W(\theta, \phi) = 1, \text{ and}$$

$$w_u[n] = \exp\left(-\frac{0.5 \ln 1e6 \, |n|}{f_s RT_{60}}\right) \text{ with } -l_u < n < l_u,$$

wherein $\tilde{D}_W$[k,i] is a first channel diffuse sound component, wherein $\tilde{D}_X$[k,i] is second channel diffuse sound component, wherein $\tilde{D}_Y$[k,i] is third channel diffuse sound component, $DFR_W$ is a diffuse-field response of the first channel, $DFR_X$ is a diffuse-field response of the second channel, $DFR_Y$ is a diffuse-field response of the third channel, $w_u$ is an exponential window, $RT_{60}$ is a reverberation time, $U_1$,$U_2$,$U_3$ is the de-correlation filter bank, u is a Gaussian noise sequence, $l_u$ is a given length of the Gaussian noise sequence, and $P_{2D\text{-}diff}$ is the diffuse noise power.

11. The audio encoding device according to claim 1, comprising an adder, which is configured to add channel-wise, the first-order ambisonic B-format direct sound signals and the higher order ambisonic B-format direct sound signals, and/or the diffuse sound signals, resulting in complete ambisonic B-format signals.

12. The audio encoding device according to claim 1, wherein delay estimator configured to estimate the angle of incidence for each pair of the N audio signal based on a travelling time delay between the pair of audio signals.

13. The audio encoding device according to claim 1, wherein delay estimator configured to estimate the angle of incidence for each pair of the N audio signal based on a delay in second and a delay in samples between the pair of audio signals.

14. An audio recording device comprising the N microphones configured to record the N audio signals, and the audio encoding device according to claim 1.

15. A method for encoding N audio signals, from N microphones where N≤3, the method comprising:

estimating angles of incidence of direct sound by estimating for each pair of the N audio signals an angle of incidence of the direct sound, deriving A-format direct sound signals from the estimated angles of incidence by deriving, from each of the estimated angles of incidence, a respective one of the A-format direct sound signals, each of the A-format direct sound signals being a first-order virtual microphone signal, and encoding the A-format direct sound signals in first-order ambisonic B-format direct sound signals by applying a transformation matrix to the A-format direct sound signals, wherein N=3, wherein the encoding further comprises performing a short time Fourier transformation on each of the N audio signals $x_1$, $x_2$, $x_3$, resulting in N short time Fourier transformed audio signals $X_1[k,j]$, $X_2[k,j]$, $X_3[k,j]$, wherein the method further comprises:

determining cross spectra of each pair of the short time Fourier transformed audio signals according to:

$$X_{12}[k,i]=\alpha_X X_1[k,i]X_2^*[k,i]+(1-\alpha_X)X_{12}[k-1,i],$$

$$X_{13}[k,i]=\alpha_X X_1[k,i]X_3^*[k,i]+(1-\alpha_X)X_{13}[k-1,i], \text{ and}$$

$$X_{23}[k,i]=\alpha_X X_2[k,i]X_3^*[k,i]+(1-\alpha_X)X_{23}[k-1,i],$$

determining an angle of the complex cross spectrum of each pair of the short time Fourier transformed audio signals according to:

$$\tilde{\psi}_{12}[k,i] = \arctan j\frac{X_{12}[k,i]X_{12}^*[k,i]}{X_{12}[k,i]+X_{12}^*[k,i]},$$

$$\tilde{\psi}_{13}[k,i] = \arctan j\frac{X_{13}[k,i]X_{13}^*[k,i]}{X_{13}[k,i]+X_{13}^*[k,i]},$$

$$\text{and } \tilde{\psi}_{23}[k,i] = \arctan j\frac{X_{23}[k,i]X_{23}^*[k,i]}{X_{23}[k,i]+X_{23}^*[k,i]},$$

performing a phase unwrapping to $\tilde{\psi}_{12}$ $\tilde{\psi}_{13}$ $\tilde{\psi}_{23}$, resulting in $\psi_{12}$ $\psi_{13}$ $\psi_{23}$ estimating the delay in number of samples according to:

$$\delta_{12}[k,i]=(N_{STFT}/2+1)/(i\pi)\psi_{12}[k,i],$$

$$\delta_{13}[k,i]=(N_{STFT}/2+1)/(i\pi)\psi_{13}[k,i],$$

$$\delta_{23}[k,i]=(N_{STFT}/2+1)/(i\pi)\psi_{23}[k,i], \text{ if } i\le i_{alias}$$

or $$\delta_{12}[k,i]=(N_{STFT}/2+1)/(i\pi)\Psi_{12}[k,i],$$

$$\delta_{13}[k,i]=(N_{STFT}/2+1)/(i\pi)\Psi_{13}[k,i],$$

$$\delta_{23}[k,i]=(N_{STFT}/2+1)/(i\pi)\Psi_{23}[k,i], \text{ if } i>i_{alias}$$

estimating the delay in seconds according to:

$$\tau_{12}[k,i] = \frac{\delta_{12}[k,i]}{f_s},$$

$$\tau_{13}[k,i] = \frac{\delta_{13}[k,i]}{f_s}, \text{ and}$$

$$\tau_{23}[k,i] = \frac{\delta_{23}[k,i]}{f_s}$$

and estimating the angles of incidence according to:

$$\theta_{12}[k,i] = \arcsin\left(\frac{c\tau_{12}[k,i]}{d_{mic}}\right),$$

$$\theta_{13}[k,i] = \arcsin\left(\frac{c\tau_{13}[k,i]}{d_{mic}}\right), \text{ and}$$

$$\theta_{23}[k,i] = \arcsin\left(\frac{c\tau_{23}[k,i]}{d_{mic}}\right),$$

and wherein:

$x_1$ is a first audio signal of the N audio signals, $x_2$ is a second audio signal of the N audio signals, $x_3$ is a third audio signal of the N audio signals, $X_1$ is a first short time Fourier transformed audio signal of the short time Fourier transformed audio signals, $X_2$ is a second short time Fourier transformed audio signal of the short time Fourier transformed audio signals, $X_3$ is a third short time Fourier transformed audio signal of the short time Fourer transformed audio signals, k is a frame of the short time Fourier transformed audio signals, and i is a frequency bin of the short time Fourier transformed audio signals, $X_{12}$ is a cross spectrum of a pair of $X_1$ and $X_2$, $X_{13}$ is a cross spectrum of a pair of $X_1$ and $X_3$, $X_{23}$ is a cross spectrum of a pair of $X_2$ and $X_3$, $\alpha_x$ is a forgetting factor, X* is a conjugate complex of X, j is the imaginary unit, $\psi_{12}$ is an angle of the complex cross spectrum of $X_{12}$, $\psi_{13}$ is an angle of the complex cross spectrum of $X_{13}$, $\psi_{23}$ is an angle of the complex cross spectrum of $X_{23}$, $i_{alias}$ is a frequency bin corresponding to an aliasing frequency, $f_s$ is a sampling frequency, $d_{mic}$ is a distance of the microphones, and c is the speed of sound.

16. A non-transitory computer readable storage medium comprising a computer program with a program code, which is configured to be executed by a computer to cause the computer to perform the method according to claim 15.

* * * * *